US007231849B2

(12) United States Patent
Beattie

(10) Patent No.: US 7,231,849 B2
(45) Date of Patent: Jun. 19, 2007

(54) REEL MOWER CONDITIONER

(76) Inventor: John M. Beattie, 3819 Saint Vrain St., Evans, CO (US) 80620

( * ) Notice: Subject to any disclaimer, the term of this patent is extended or adjusted under 35 U.S.C. 154(b) by 220 days.

(21) Appl. No.: 10/741,258

(22) Filed: Dec. 19, 2003

(65) Prior Publication Data

US 2004/0128812 A1 Jul. 8, 2004

Related U.S. Application Data

(60) Provisional application No. 60/436,419, filed on Dec. 23, 2002.

(51) Int. Cl.
*B21K 19/00* (2006.01)

(52) U.S. Cl. ..... 76/82.1; 83/174

(58) Field of Classification Search ..... 451/8, 451/9, 10, 11, 122, 123, 128, 141; 76/82, 76/82.1; 83/174, 174.1; 409/188, 195, 207–209, 409/133; 56/1, 249

See application file for complete search history.

(56) References Cited

U.S. PATENT DOCUMENTS 3,729,907 A * 5/1973 Burrough et al. ..... 56/DIG. 1
RE28,200 E 10/1974 Witt et al.
4,148,158 A 4/1979 Hewitt
4,163,345 A 8/1979 Meili
4,192,103 A 3/1980 Sousek
4,485,591 A 12/1984 Bolin
4,550,532 A 11/1985 Fletcher, Jr. et al.
4,746,330 A 5/1988 Johnson
5,012,617 A 5/1991 Winstanley
5,211,264 A * 5/1993 Beattie et al. ..... 187/208
5,321,912 A 6/1994 Neary et al.
5,549,508 A 8/1996 Searle et al.
5,725,415 A 3/1998 Bernhard
5,879,224 A 3/1999 Pilger
6,010,394 A 1/2000 Dieck et al.

(Continued)

FOREIGN PATENT DOCUMENTS

GB 2 170 740 A 8/1986

(Continued)

OTHER PUBLICATIONS

International Search Report for application No. PCT/US 03/41021, filing date Dec. 22, 2003.

*Primary Examiner*—Jason Prone
(74) *Attorney, Agent, or Firm*—Rick Martin Patent LawOffices of Rick Martin, PC

(57) ABSTRACT

A computer controlled all-in-one reel mower sharpener and roller alignment system can be rolled under a mower to be conditioned. No removal of the cutting unit is needed. A linear voltage displacement transducer (LVDT 715 or a mechanical dial indicator 7155; alternatively a friction wheel 7150 with a rotary encoder 7151 may be used, or any combination of sensors 715, 7155, 7151) or equivalent instructs the machinist how to align the front and rear rollers in parallel. A laser scanner or probe determines the location for the cutter, and then the machining head sharpens each blade automatically. A separate cutter sharpens the bed knife. Most all mowers can be conditioned based on the laser or probe calibration of the blade size. The laser or probe measures the height of cut by sensing the blade location.

15 Claims, 28 Drawing Sheets

U.S. PATENT DOCUMENTS 6,122,902 A * 9/2000 Loehr ..... 56/15.2
6,203,402 B1 * 3/2001 Hildebrandt ..... 451/8
6,290,581 B1 9/2001 Dieck et al.
7,114,318 B2 * 10/2006 Poulson et al. ..... 56/249

FOREIGN PATENT DOCUMENTS

WO WO 2004/058449 A2 * 7/2004

* cited by examiner

REEL MOWER CONDITIONER

CROSS REFERENCE APPLICATIONS

This application is a non-provisional application claiming the benefits of provisional application No. 60/436,419 filed Dec. 23, 2002.

FIELD OF INVENTION

The present invention relates to providing maintenance to golf course reel mowers by using a laser based scanner or a probe to align the frame components, setting the height of cut and using a linear voltage transducer or equivalent to level the front and rear rollers, and using various machining cutters for sharpening the blades and the bed knife, all by computer control.

BACKGROUND OF THE INVENTION

Maintaining golf course grass is a science. A clean cut on each blade of grass is preferred because a ragged cut stunts growth and weakens the grass. When the grass is weakened it becomes prone to disease. Diseased grass is attacked by weeds. When weeds develop costly chemicals are needed to kill the weeds. In order to cut the grass cleanly, reel mower blades need to be sharpened frequently. Most prior art sharpening systems require removing the reels from the mower frame to perform the sharpening process. This removal and re-installation of the reel blades is costly in terms of labor costs as well as downtime for the expensive power lawnmower.

A brief summary of the prior art sharpeners follows below. Dieck et al. '581 claims to perform both the "true" grind of the reel tips and the "relief" grind of the trailing edge of each blade without the removal of the reel from the mower.

U.S. Pat. No. Re 28,200 (1974) to W. E. Witt et al. discloses a reel lawnmower sharpener, wherein a motorized grinder is mounted to the frame to sharpen the blades.

U.S. Pat. No. 4,148,158 (1979) to Hewitt discloses a lathe-type machine, which receives the frame of a reel mower, and mechanically grinds each blade.

U.S. Pat. No. 4,163,345 (1979) to Meili discloses a rotary lawnmower sharpener.

U.S. Pat. No. 4,192,103 (1980) to Sousek discloses a reel lawnmower grinder that has an automatic indexing device to advance the cutter reel blades into the grinder.

U.S. Pat. No. 4,485,591 (1984) to Bolin discloses a portable, ground mounted motorized grinder on a frame which can connect to the underside of a reel type mower.

U.S. Pat. No. 4,550,532 (1985) to Fletcher, Jr. et al. discloses a robotic grinder for grinding an elongated blank.

U.S. Pat. No. 4,746,330 (1988) to Johnson discloses a reel mower blade sharpener with a pulley system to rotate the blades in synch with the sharpener.

U.S. Pat. No. 5,012,617 (1991) to Winstanley discloses in FIG. 4 a reel mower blade assembly mounted on a dual purpose grinder for sharpening both the rotating blades and the fixed bottom blades.

U.S. Pat. No. 5,321,912 (1994) to Neary et al. discloses a tabletop spin grinder for a reel type mower, wherein the perfect cylindrical shape of the blade is assured.

U.S. Pat. No. 5,879,224 (1999) to Pilger discloses a tabletop grinder for a reel mower, with an automatic blade indexer.

U.S. Pat. No. 5,549,508 (1996) to Searle et al. discloses a tabletop grinder for a reel mower, with an indexer and a dampening mechanism to minimize grinding vibrations.

U.S. Pat. No. 5,725,415 (1998) to Bernhard discloses a portable grinder for the bed knife or bottom blade of a reel mower.

U.S. Pat. No. 6,010,394 (2000) to Dieck et al. discloses a tabletop reel grinder with sophisticated blade indexing to reduce manual adjustments after initial first blade setup.

U.K. Patent No. 2 170 740 A (1986) discloses a tabletop reel grinder with a single hydraulic actuator for the traverse means for the grinder and the blade rotator is provided.

U.S. Pat. No. 6,290,581 B1 (2001) to Dieck et al. is assigned to Foley-Belsaw Company. The invention features a tabletop grinder for a reel blade. Both the "true" grind and the "relief" grind steps and automatic indexing are provided. A mechanical sensor (FIG. 7, 42) senses the blade position which controls the vertical positioning of the grinding head.

Each reel has a front and a rear roller which need to be parallel and set to a proper height. All known methods are manual to align these rollers.

Height adjustments for a golf course are complex. Generally the deep rough is set at 1½ to 2 inches. The intermediate rough is set at 1 to ¼ inch. The fairway is set at ½ to 1 inch. The greens are set at 3/32–3/16 inch. The tees are set from 3/16–½ inch. Height adjustments are set to 0.001 inch for precision.

The present invention is rolled under a power lawnmower which is usually lifted on a power lift. No removal of the cutting units is necessary. A laser or a mechanical probe, an encoder, and a cutter based system is operated by the machinist using an on-board computer controller. The rollers are aligned using the encoder. The reel blades are sharpened using a machining head with end cutter. The bed knife is sharpened using the machining head with back facing cutter. The height adjustment is measured by the laser scanner or encoder probe to the exacting requirements of each height setting. Additionally the reel cylinder axis is measured by the laser scanner or encoder probe.

The overall benefits to the golf course owner are a very precisely conditioned reel mower which reduces costs to maintain the grass. The precise conditioning is also achieved in less time, thus reducing maintenance costs for the golf course. The system offers benefits to any grass mowing maintenance operation.

SUMMARY OF THE INVENTION

The primary aspect of the present invention is to provide a reel mower conditioning system that sharpens the blades and aligns the rollers—all without removing the cutting units from the chassis of the mower.

Another aspect of the present invention is to provide a laser scanner to direct the positioning of a power cutter used for sharpening the blades and the bed knife.

Another aspect of the present invention is to use an accurate means to align the front and rear rollers in parallel.

Another aspect of the present invention is to use the laser scanner or a probe to precisely set the cutting height.

Another aspect of the present invention is to use a mechanical feeler to precisely set the cutting height.

Another aspect of the present invention is to provide a blade end cutter that has a guide which keeps the blade edge centered on the cutter, thereby allowing the blade edge to be sharpened in one pass instead of a typical two pass "true and relief" method.

Another aspect of the present invention is to provide a computer controlled, menu driven screen to guide the machinist through the various tasks.

Another aspect of the present invention is to align the rollers to the axis of the reel cylinder.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Glossary

Cutting Unit: reel, roller, knife assembly of a reel mower.

Blade: one of several cutting edges of reel cylinder on a cutting unit.

Reel Cylinder: assembly of several blades which spins to produce cut.

Bed Knife: fixed cutting edge which provides second half of scissor cutting.

Grinding: abrasive metal removal other (existing) technology.

Machining: single point metal removal (new technology disclosed herein).

Machining Head: drive system for cutters used to sharpen by machining.

Linear Voltage Displacement Transducer (LVDT) Assembly: a rocker arm assembly is connected to a LVDT transducer which senses proper parallelism of a front roller to a fixed rear roller after the fixed rear roller has been adjusted parallel to the reel cylinder.

Figure 1:
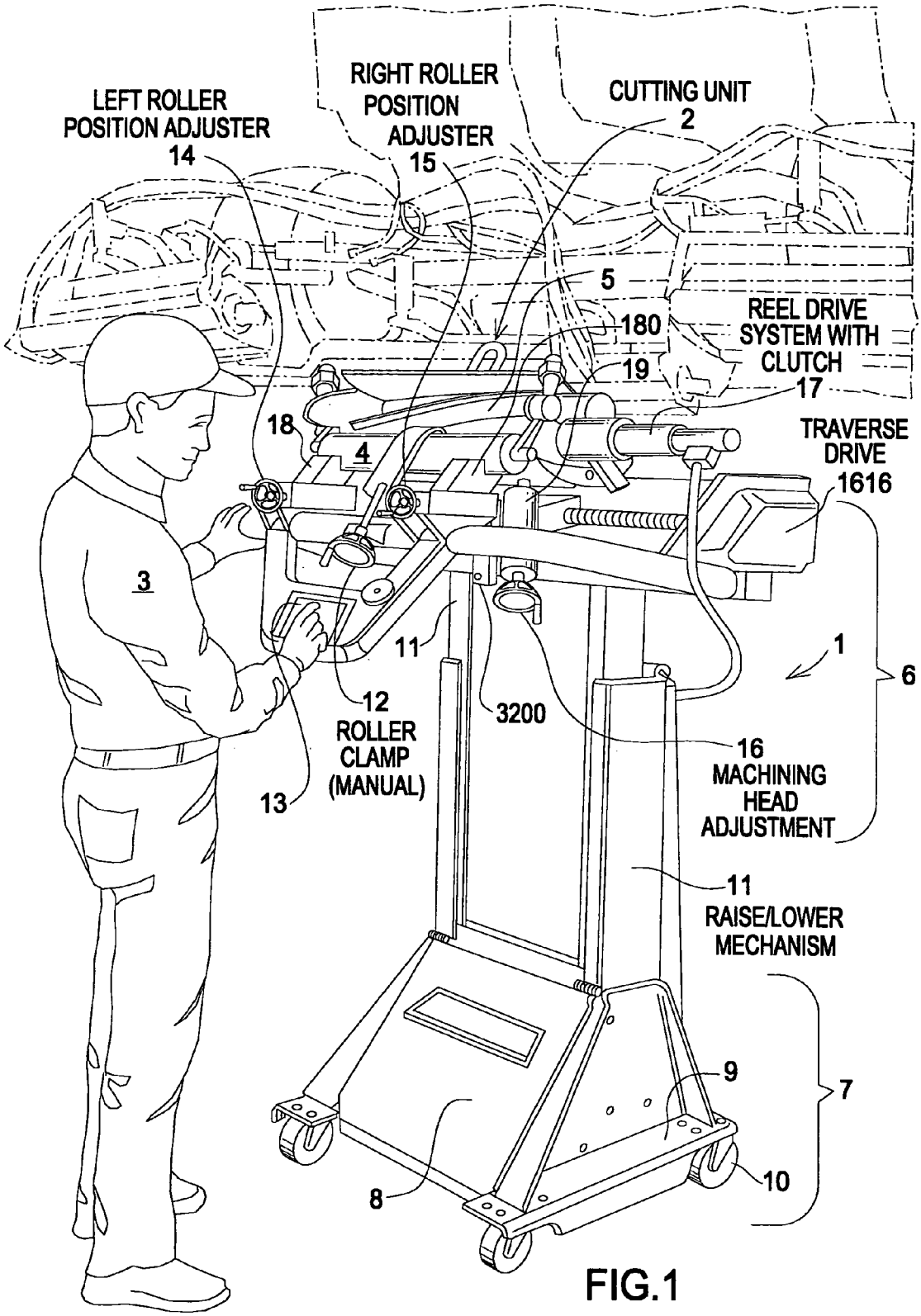
FIG. 1 is a perspective view of the preferred embodiment reel mower conditioner.

Referring first to FIG. 1 a front perspective view of a preferred embodiment reel mower conditioner 1 shows a machinist 3 using the touch screen 13. A cutting unit 2 is shown mounted on the machining sub-assembly 6. The machining sub-assembly 6 is supported on the base 7. The base 7 has wheels 10, a frame 9 and a battery and electronics housing 8. The wheels 10 enable the machinist 3 to roll the conditioner 1 under a power lawnmower and raise the machining sub-assembly 6 up to meet the cutting unit 2. The raise/lower mechanism 11 controls the height of the machining sub-assembly 6. One roller 4 can be seen locked into fixed roller supports 18, 180. The second roller is supported by a rocker arm assembly 3400 attached to the mechanical dial indicator 7155; alternatively a friction wheel 7150 with a rotary encoder 7151 may be used, or any combination of sensors 715, 7155, 7151 whose operation is described in FIG. 31, wherein these devices may be characterized as level position sensing devices. Alternatively an LVDT could work with circuitry to accommodate ambient temperatures and voltage fluctuations. Another equivalent to the mechanical dial indicator 715 would be a linear encoder with a shaft connected to the rocker arm assembly 3192. The blades(s) 5 of the cutting unit 2 can also be seen. The blades 5 are rotated by the reel drive system and clutch assembly 17. The roller 4 is locked in place by the roller 4 clamp 12 after the left roller position adjuster 14 and the right roller position adjuster 15 are adjusted to accommodate the particular cutting unit 2 size.

The machining head assembly 19 holds various machining cutters for the true and relief cuts of the blades 5 and the sharpening of the bed knife. The traverse drive 1616 moves the machining head assembly 3333 after the machining requirements are calculated by a laser or a probe 3200 type blade analyzer (FIG. 33) which is also moved by the transverse drive 1616.

Figure 2:
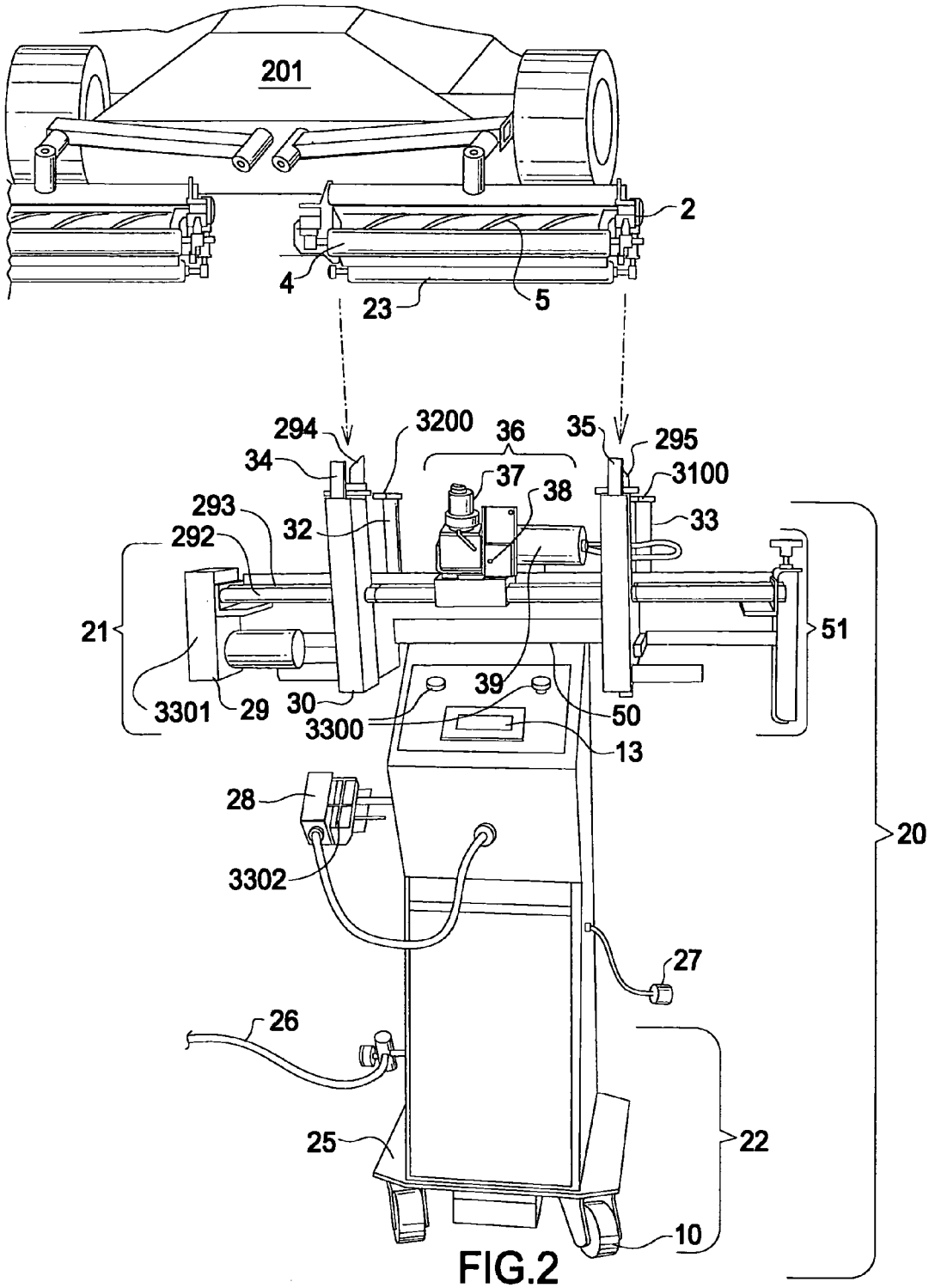
FIG. 2 is a front perspective view of an alternate embodiment reel mower conditioner placed under a reel type blade of a lawnmower.

Referring next to FIG. 2 a front perspective view of an equivalently functioning reel mower conditioner 20 to that of the conditioner 1 of FIG. 1 is shown. The front roller 23, rear roller 4 and blade 5 of the cutting unit 2 can be seen. The conditioner 20 consists of a base 22 having a frame 25 and wheels 10 to enable the conditioner to be rolled under the power lawnmower 201. The cutting unit 2 remains mounted in the power lawnmower 201.

Figure 31:
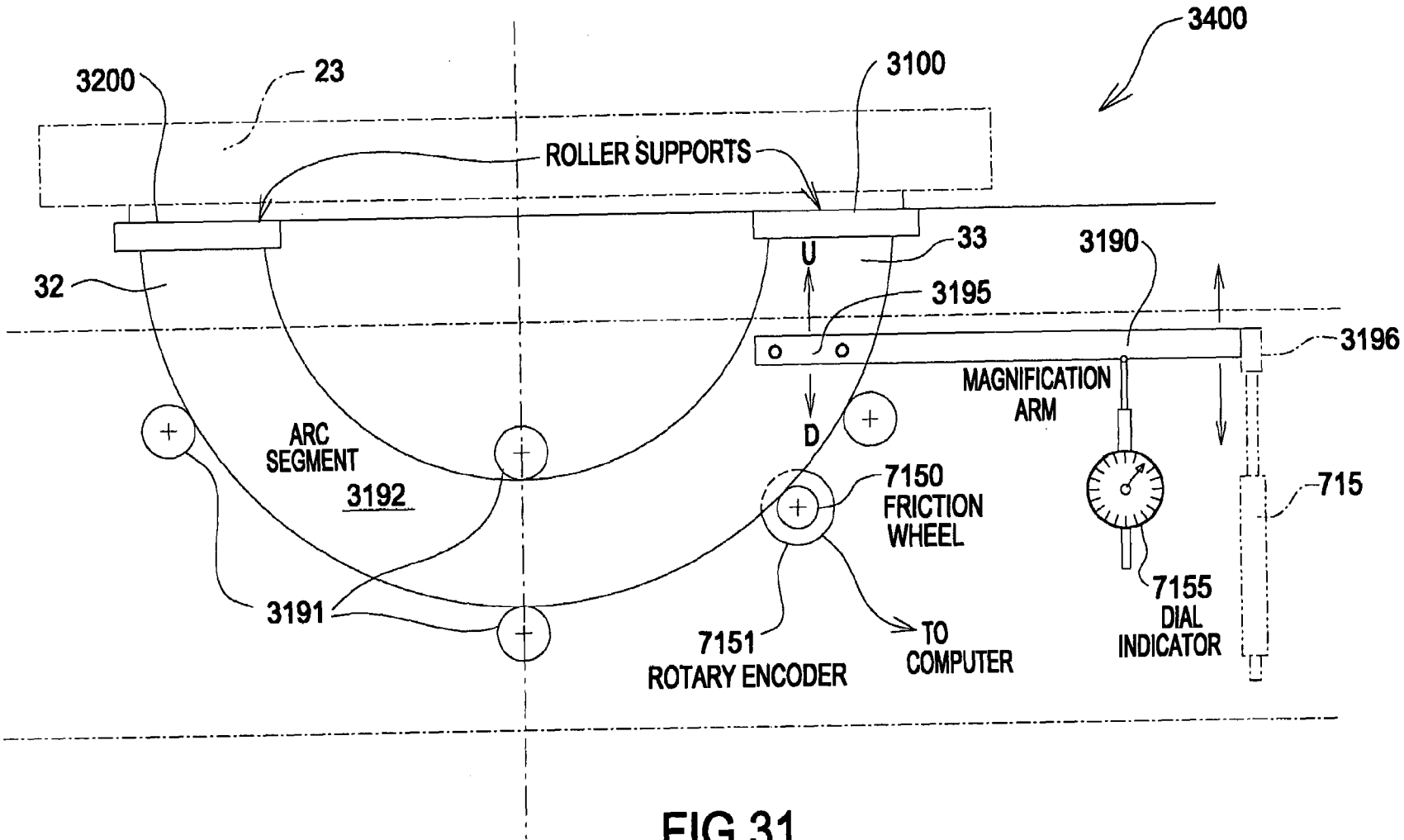
FIG. 31 is an alternative schematic view of the roller alignment assembly using the mechanical dial indicator 7155; alternatively a friction wheel 7150 with a rotary encoder 7151 may be used, or any combination of sensors 715, 7155, 7151.

The first step for conditioning is frame alignment. In referring to FIG. 13 the reel cylinder 1359 is measured to be in perfect alignment with the frame of the cutting unit 2. The roller 4 in our illustration is a rear roller that can be set by hand to parallel with the reel cylinder 1359. The roller 4 is resting on fixed, non-movable columns 30, 31. To ensure parallelism of the roller 4 to the reel cylinder 1359, a laser beam or a mechanical probe mounted on the machining head assembly 36 is set at the left end of the roller, near the roller support 30, FIG. 8 number 30. The laser beam or the probe measures the distance up to the shaft of the reel cylinder. Next the process is repeated on the right side by the right roller support, FIG. 6A number 31. Next the roller support brackets 94 are adjusted as shown in FIG. 9 until the two above mentioned measurements are the same. Now the rocker arm assembly 3400 in conjunction with the level position sensing device described in FIG. 31 is used to align the (front) roller 23 to the (rear) roller 4 as described in the discussion of FIG. 7. This step completes the frame alignment process.

The machining sub-assembly 21 has a touch screen 13, a pneumatic supply hose 26 and an AC power cord 27. A raising/lowering mechanism 50 (FIG. 5) raises the conditioning assembly 51. The reel is controllably rotated by the reel drive system with a slip clutch 28, which is shown attached to the reel in FIG. 8. The transverse drive 29 consists of an electric motor to turn the transverse screw 291 which is located between the support guides 292, 293.

The left roller support column 30, and the right roller support column 31 support the rear roller 4. Roller clamps 34, 35 lock against the roller 4 before any conditioning steps begin. Rear stops 294, 295 brace the roller 4 against the roller clamps 34, 35. Rear rocker arm columns 32, 33 support the front roller 23. These rocker arm columns 32, 33 are part of the rocker arm assembly 3400 that are connected to the mechanical dial indicator 7155; alternatively a friction wheel 7150 with a rotary encoder 7151 may be used, or any combination of sensors 715, 7155, 7151 via a magnification arm 3190 as shown in FIG. 31 and FIG. 7B. The rocker arm columns are labeled 3200 and 3100 respectively, as better seen in FIG. 4. Alternatively a LVDT could work with circuitry to accommodate temperature and voltage fluctuations. Another equivalent to the mechanical dial indicator 715 would be a linear encoder sensing the position of the rocker arm assembly 3400. The machining head assembly 36, best shown in FIG. 2, includes a machining head 37 that holds various cutting/grinding tools, a laser 38 that calibrates the blade edges for machining, and a motor 39. The machining head assembly 36 moves along the support guides 292, 293 via the traverse screw drive 29.

Figure 3:
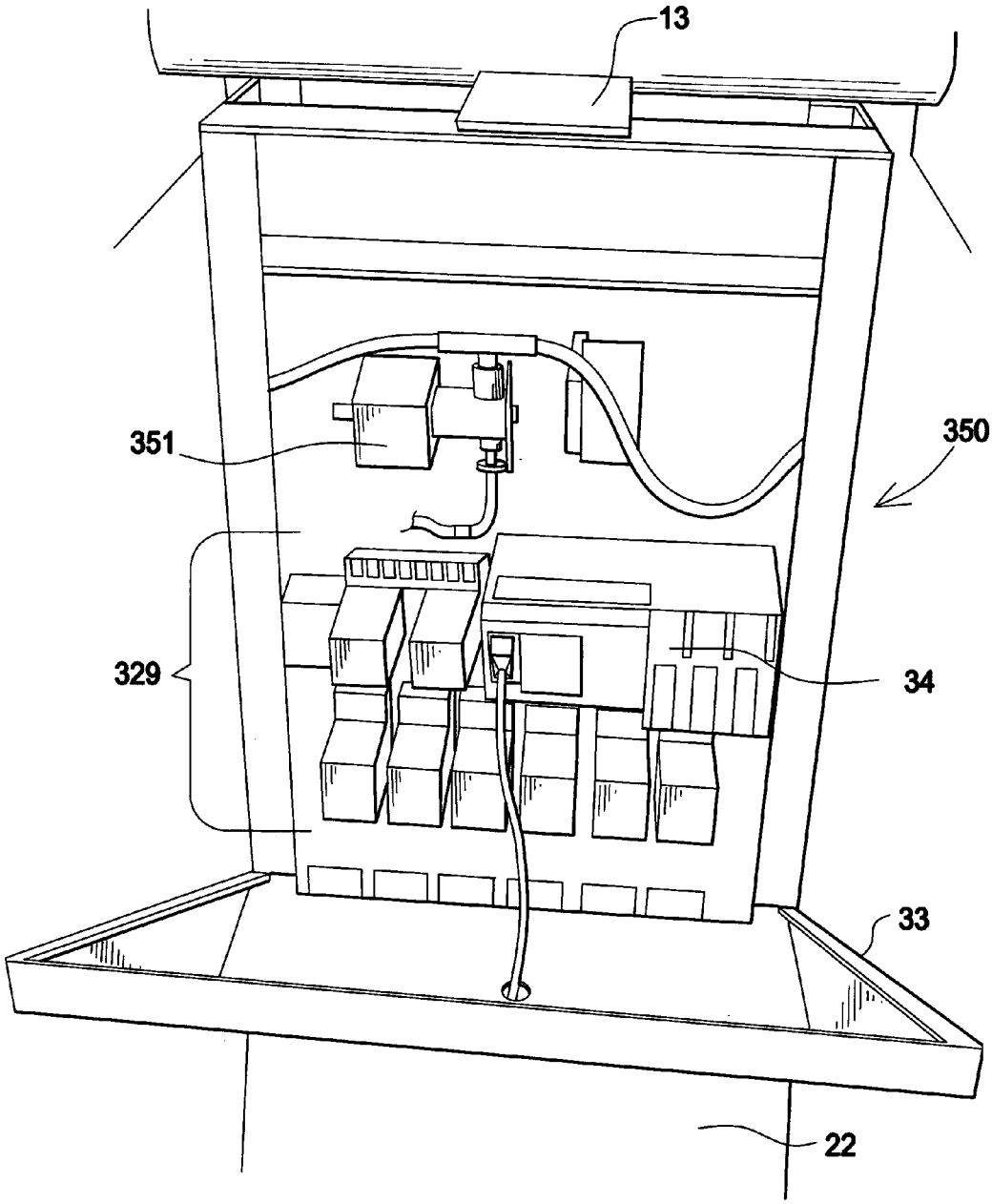
FIG. 3 is a close up view of the open front hatch of the electronic controller of the FIG. 2 embodiment.

Referring next to FIG. 3 the electronics/control compartment 30 has a front door 33. The roller clamps 34, 35 are run by a pneumatic control valve 31. The DC power supply 329 feeds all electronic components including the computer, (preferably a pc based imbedded computer, however a PLC can be used) 34. All other powered parts are run from battery.

Figure 4:
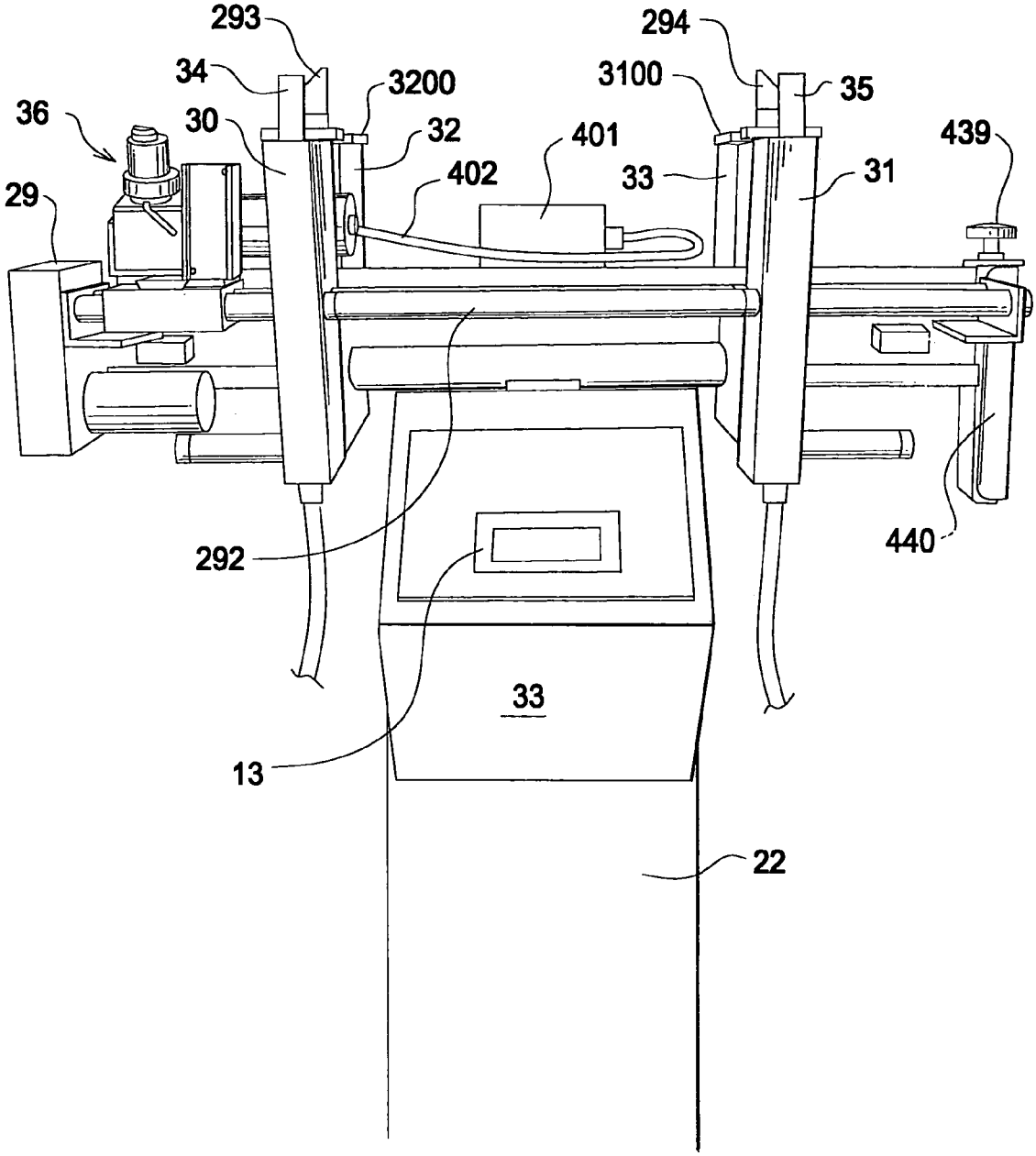
FIG. 4 is a front plan view of the embodiment shown in FIG. 2 with the alignment and sharpening assembly in the lowermost position.
Figure 5:
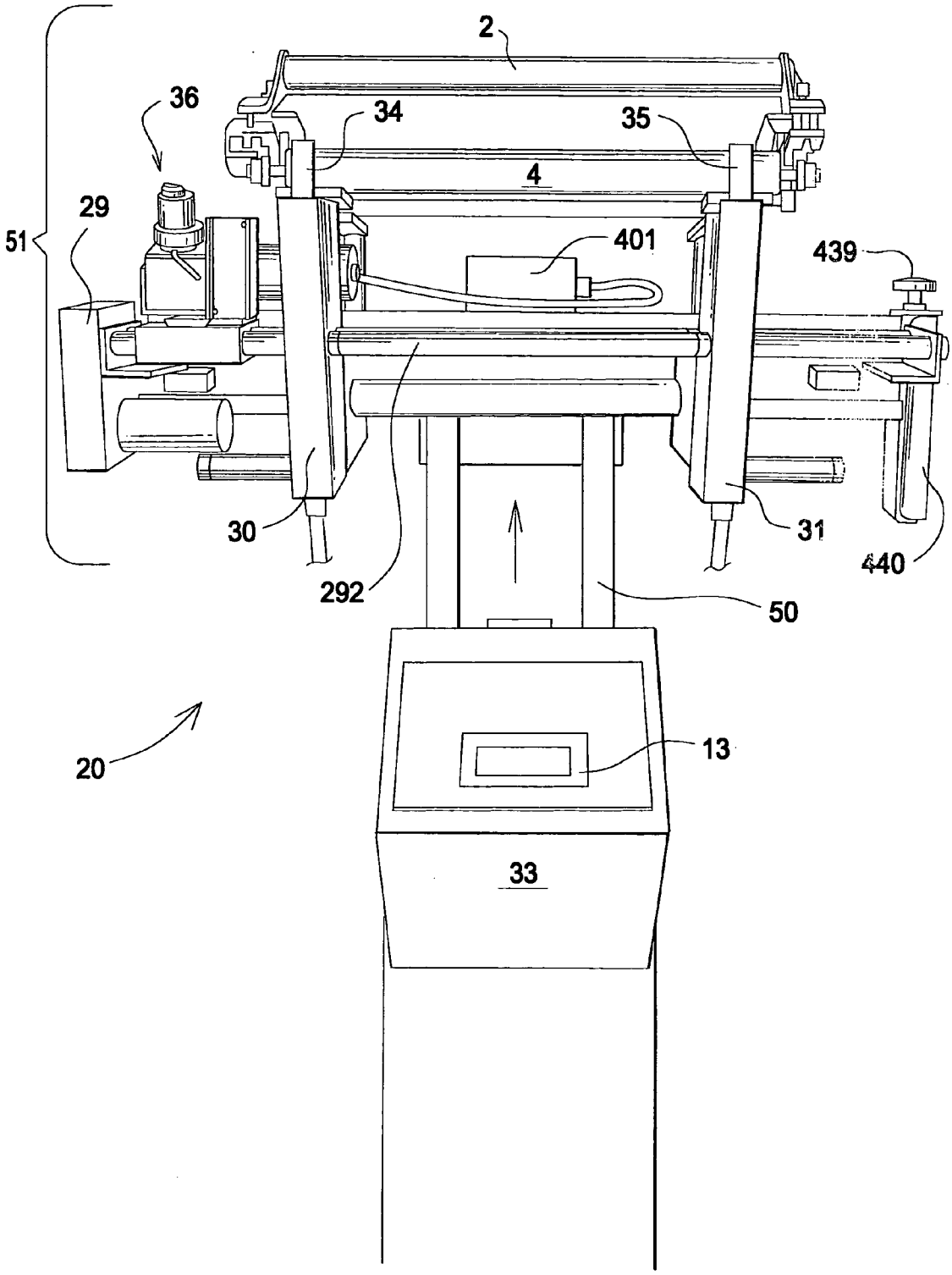
FIG. 5 is the same view as FIG. 4 with the alignment and sharpening assembly in the raised position engaging the front and rear rollers of the reel mower.

Referring next to FIG. 4 the machining head assembly 36 is moved all the way left to allow the open roller clamps 34, 35 to receive a cutting unit as shown in FIG. 5. Electric housing 401 houses the wiring 402 to the machining head assembly 36. The housing 440 supports the calibration adjustment knob 439 for setting zero deviation of the rocker arm assembly 3400 as best shown in FIGS. 7A, 7B.

Referring next to FIG. 5 the raising mechanism 50 has raised the conditioning assembly 51 which has received the cutting unit 2.

Figure 6A:
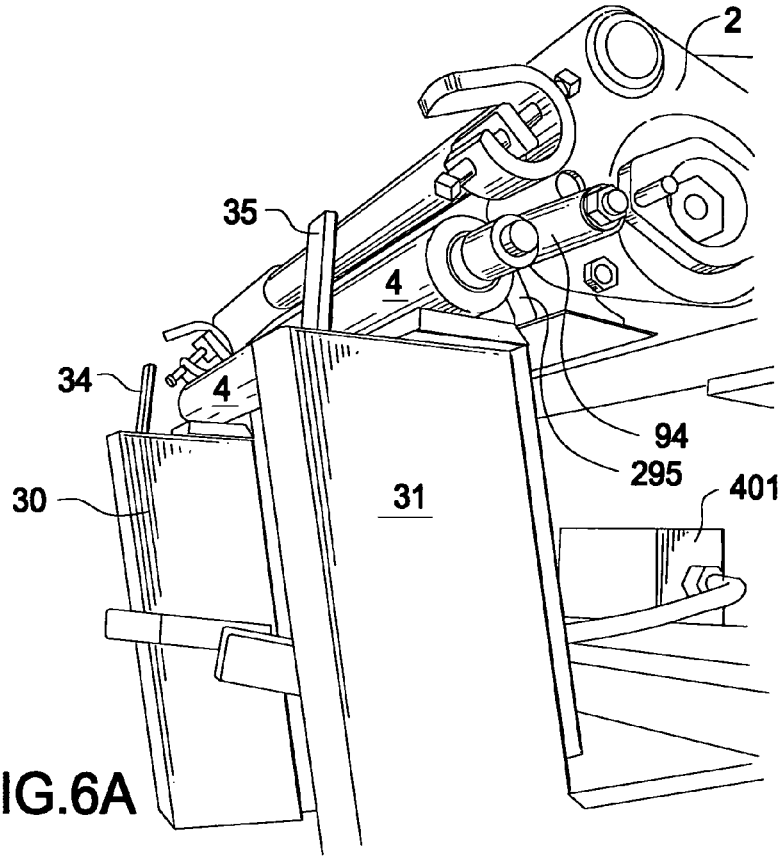
FIG. 6A is a right side perspective view of the rear roller engaged with the alignment and sharpening assembly with the roller clamp open.
Figure 6B:
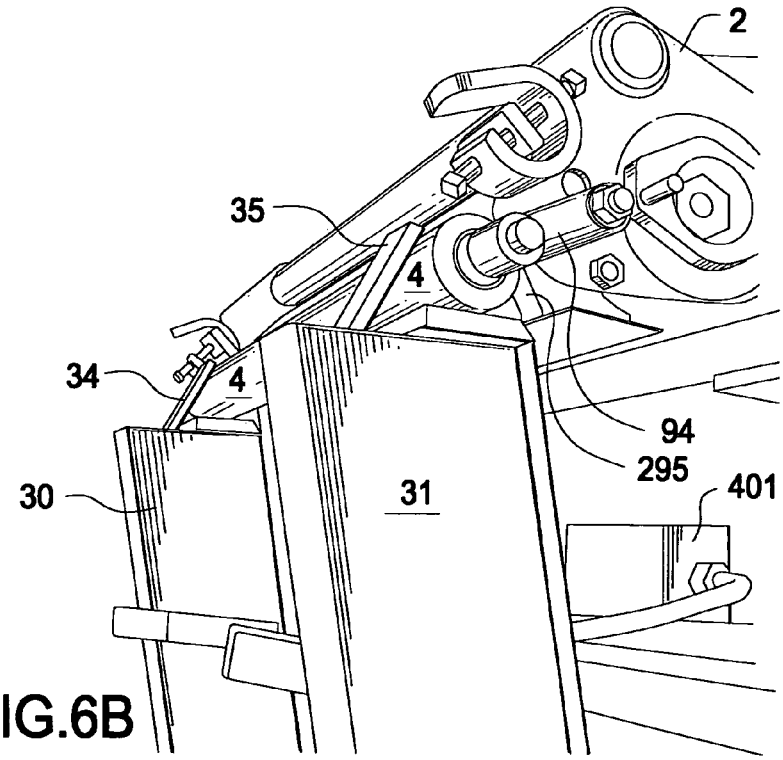
FIG. 6B is the same view as FIG. 6A with the roller clamp closed.

In FIG. 6A the roller clamps 34, 35 are still open. In FIG. 6B the roller clamps 34, 35 have been pneumatically shut, thereby locking the roller between the roller clamps 34, 35 and the stops 294, 295 (shown in FIG. 2).

Figure 7A:
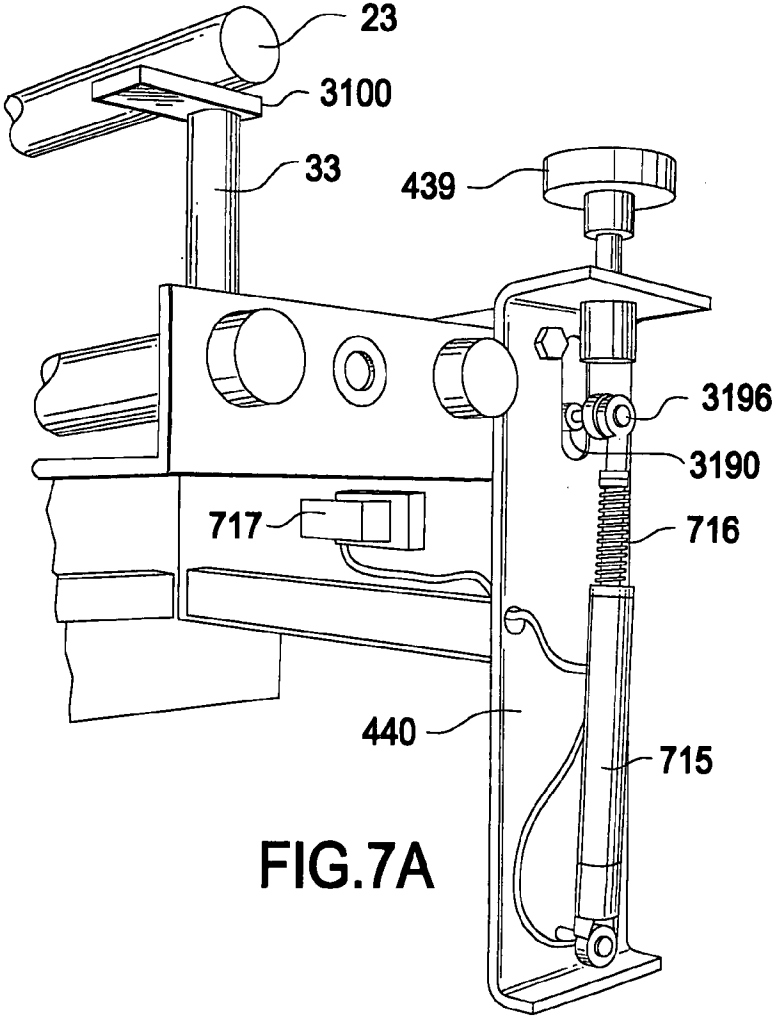
FIG. 7A is a close up perspective view of the right side of the linear voltage displacement transducer 715.
Figure 7B:
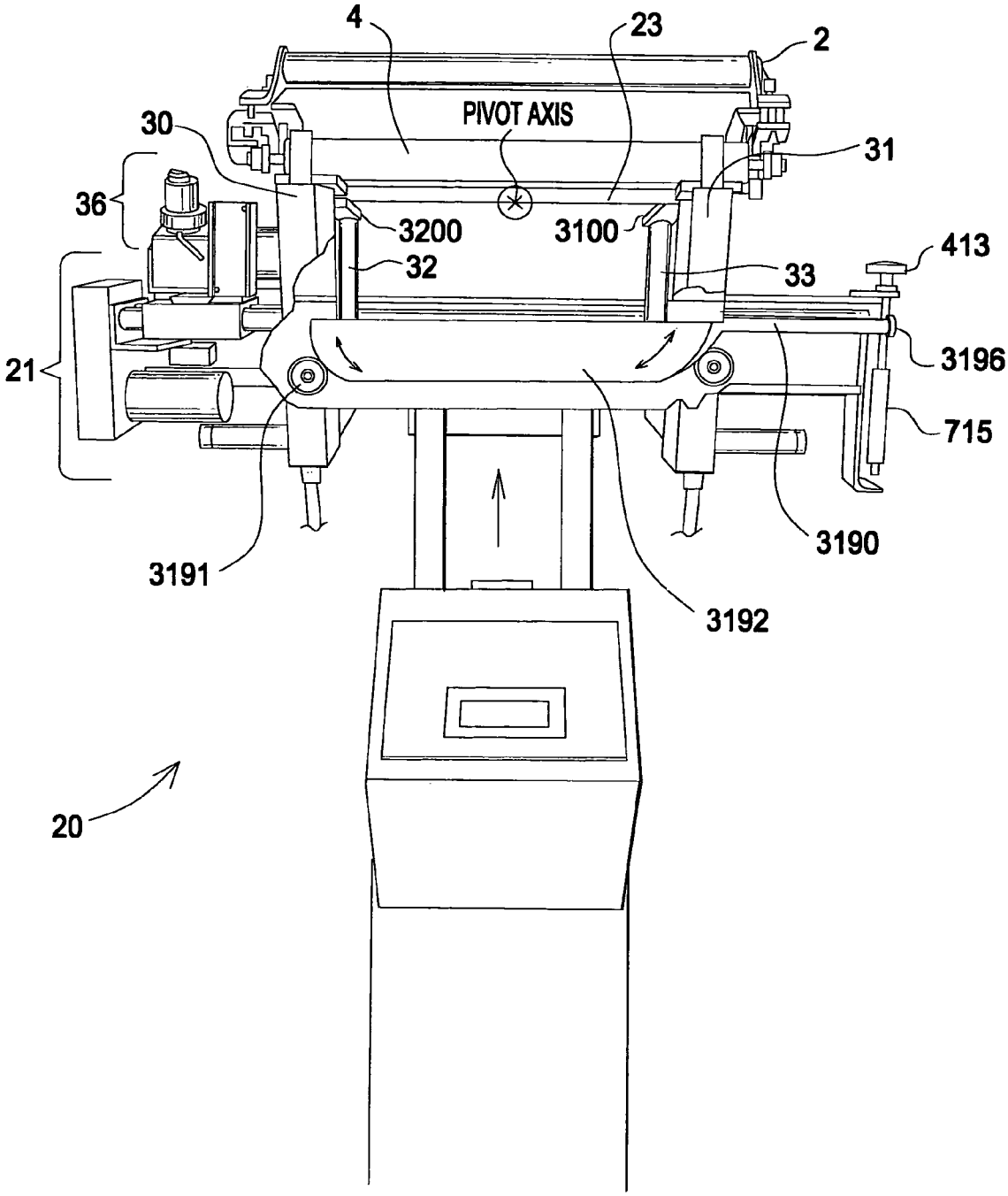
FIG. 7B is a front plan view of an alternate embodiment system 20 as shown in FIG. 2.

Referring next to FIG. 7A, the cover for the level position sensing device described in discussion of FIG. 4, 31 transducer housing has been removed to expose the LVDT 715 a mechanical dial indicator 7155; alternatively a friction wheel 7150 with a rotary encoder 7151 may be used, or any combination of sensors 715, 7155, 7151. The calibration adjustment knob 439 adjusts the level position sensing device length to establish a zero deviation from the plane of the fixed roller supports (18, 180 in FIG. 1). In FIG. 31 the roller 23 rests on the tops 3200, 3100 of rocker arm columns 32, 33. Bearings 3191 allow the arc segment 3192 to slide to reflect the tilt, if any, of roller 23. The magnification arm 3190 translates the displacement at juncture 3195 to the top 3196 of the level position sensing device transducer 715.

FIG. 7B is the same view as FIG. 5 with a cut-a-way of the frame showing front roller supports 32, 33 with rocker arm 3192 supported on roller bearings 3191. Also shown is magnification arm 1390 and connection to LVDT 715 or a level position sensing device described in discussion of FIGS. 4, 31.

Figure 8:
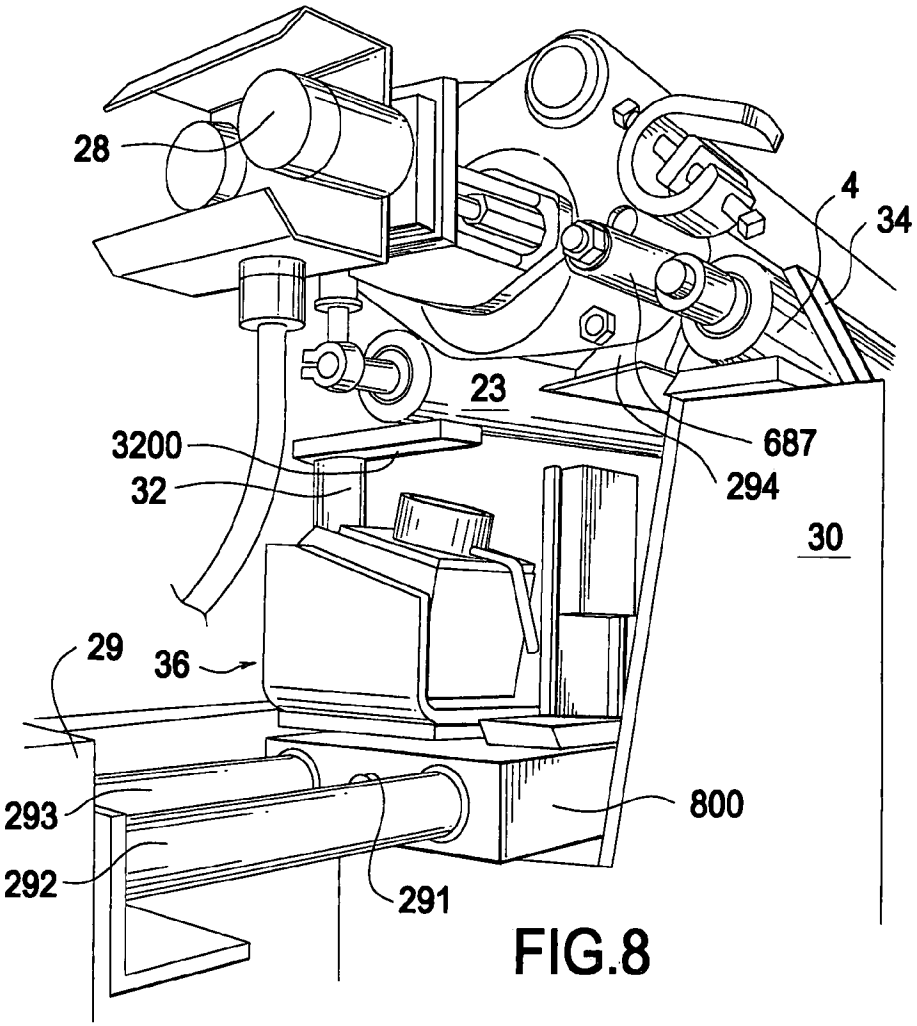
FIG. 8 is a close up perspective view of the reel drive system with the slip clutch.
Figure 9:
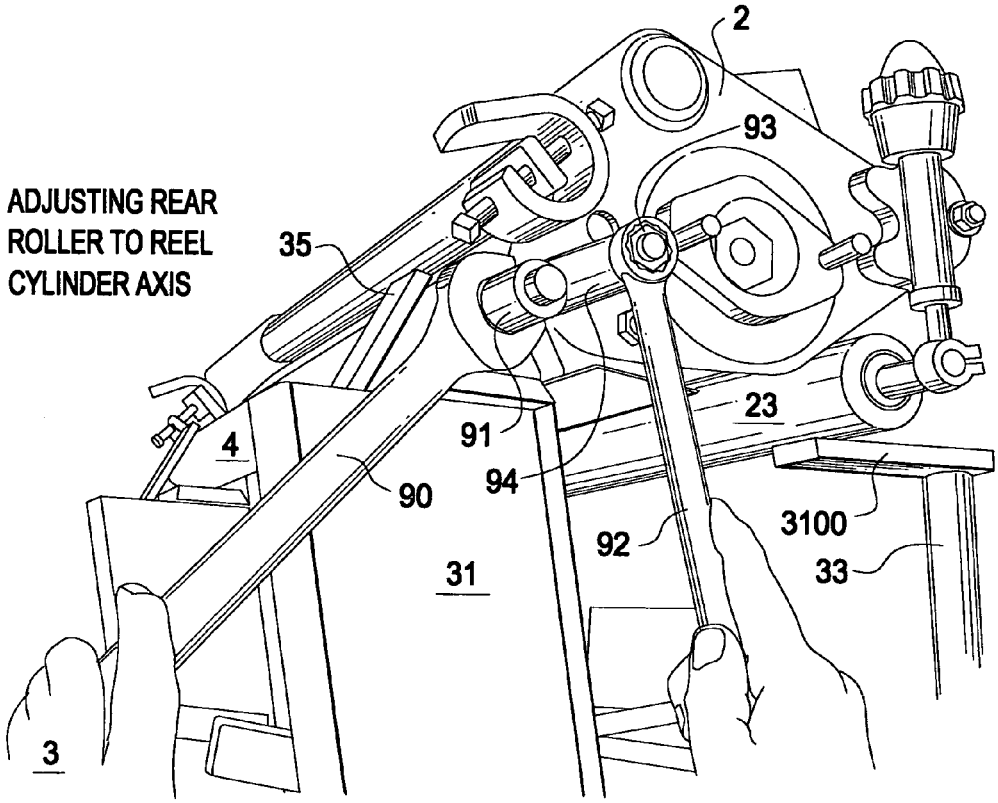
FIG. 9 is a right side perspective view of the rear roller being manually adjusted to be parallel with the reel cylinder axis.

Referring next to FIG. 8 the base 800 of machining head assembly 36 has a stationary nut inside which moves the base 800 as the screw 291 is powered by the screw drive 29.

Referring next to FIG. 9 the machinist 3 adjusts the roller 4 to reel cylinder axis alignment in a known manner using an open end wrench 90 on roller end 91 and loosening nut 93 on the bracket 94 that supports the roller 4.

Figure 10:
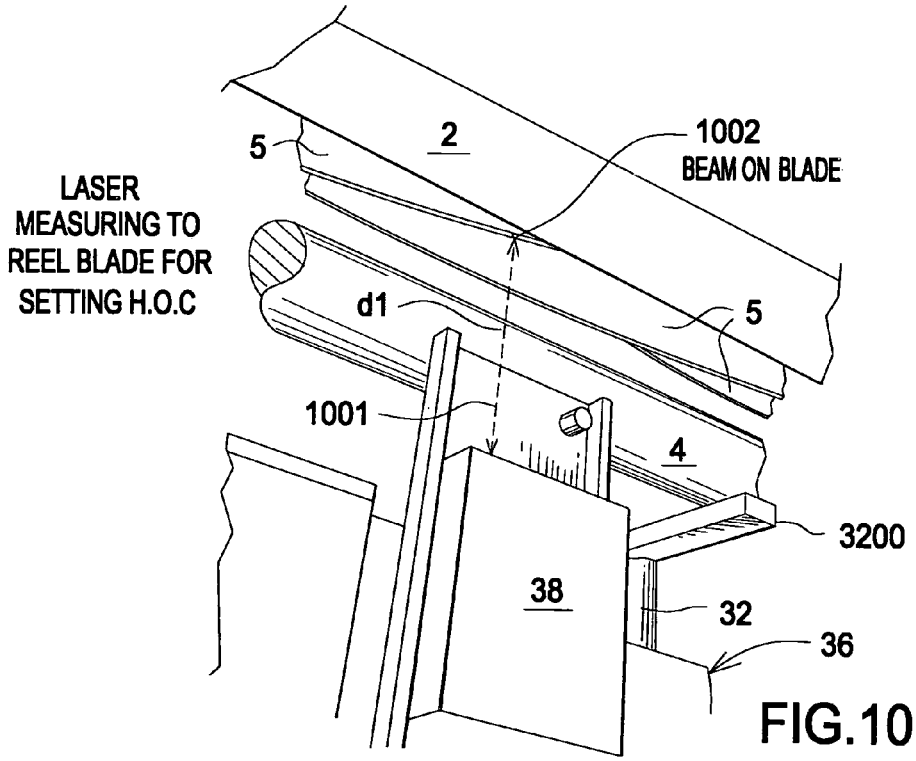
FIG. 10 is a rear perspective view of the laser scanner scanning the edge of a blade in preparation for a height adjustment of cut.

Referring next to FIG. 10 the laser 38 shines a beam 1001 to the cutting edge 1002 of the blade 5. The computer FIG.

3, 34 stores the distance $d_1$ (height of cut, H.O.C.) of the cutting head in relationship to the plane of the rollers.

Figure 11:
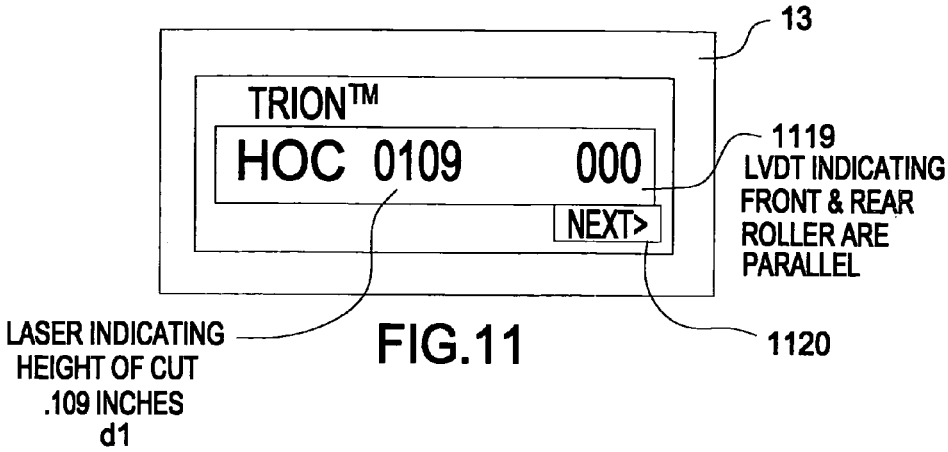
FIG. 11 is a front plan view of the control panel screen.

Referring next to FIG. 11 the touch screen 13 displays H.O.C., $d_1$ of FIG. 10, as 0.109 inch. Field 1119 indicates a zero deviation from parallel between the front and rear roller as described above in the frame alignment paragraph. Field 1120 showing "NEXT" allows the machinist to proceed to the next step.

Figure 12:
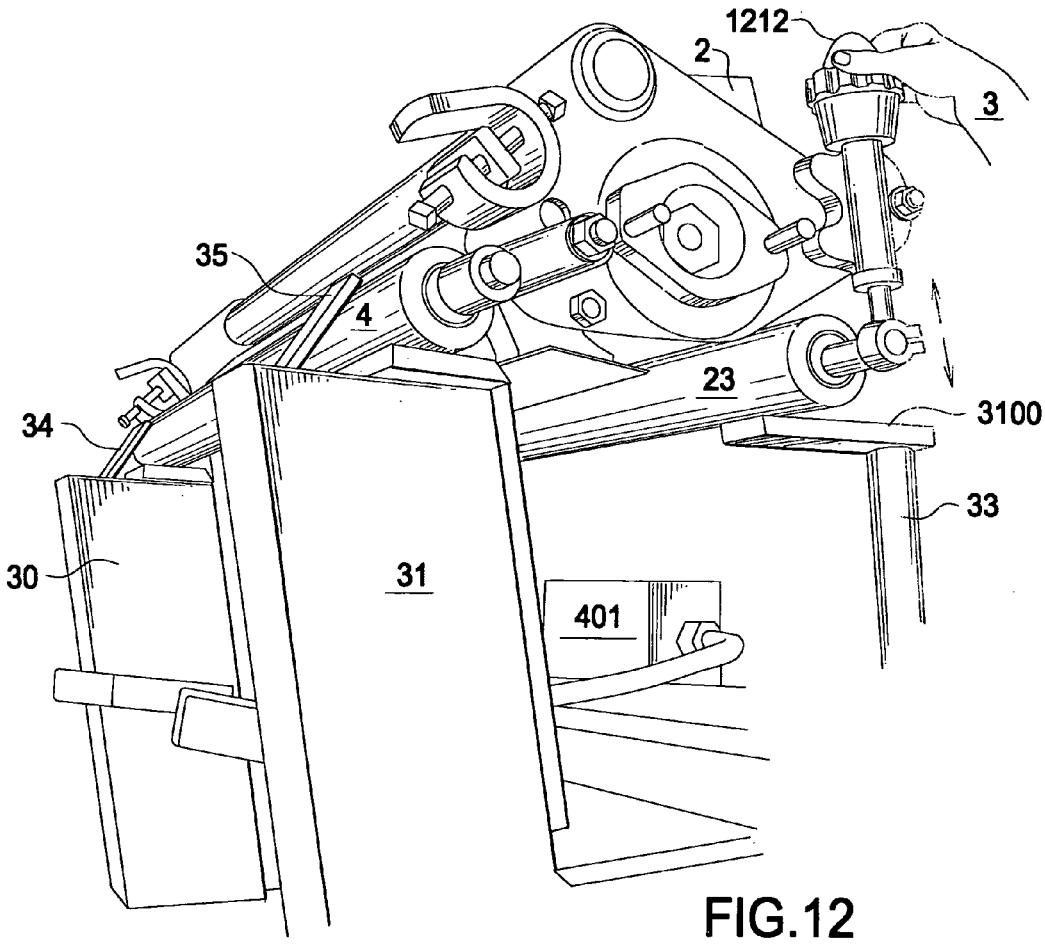
FIG. 12 is a right side perspective view of a manual adjustment of the cutting height knob.

Referring next to FIG. 12 the roller clamps 34, 35 are closed. The machinist 3 is adjusting the height of cut (H.O.C.) by moving the front roller 23 up or down using knob 1212. The opposing knob (not shown) must be set at the same H.O.C. in order for the rocker arm top 3100 to be level with rocker arm top 3200, thereby providing a perfect alignment signal from the level position sensing device as described in discussion of FIGS. 4, 31.

Figure 13:
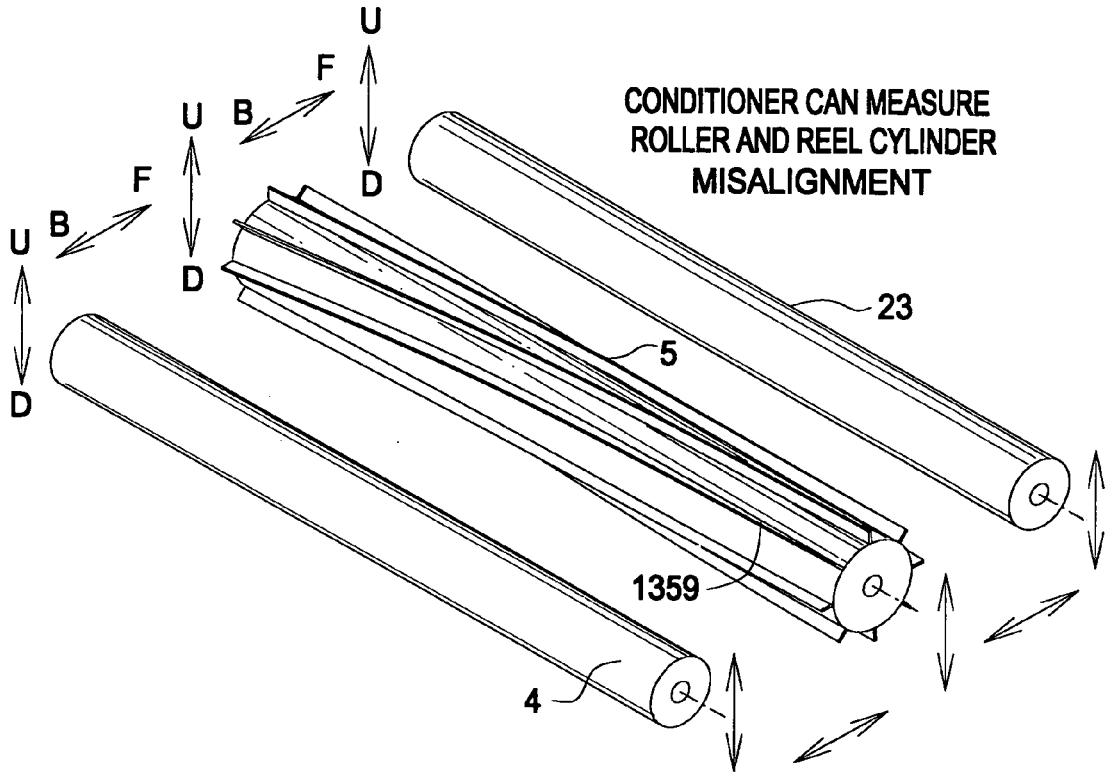
FIG. 13 is a diagrammatic view of a cutting reel and a front and rear roller and their alignments.

Referring next to FIG. 13 the rollers 4,23 and the reel cylinder 1359 must be all parallel. The arrows up (U), down (D) forward (F), and back (B) indicate the manual adjustments potentially available on the cutting unit 2.

Figure 14:
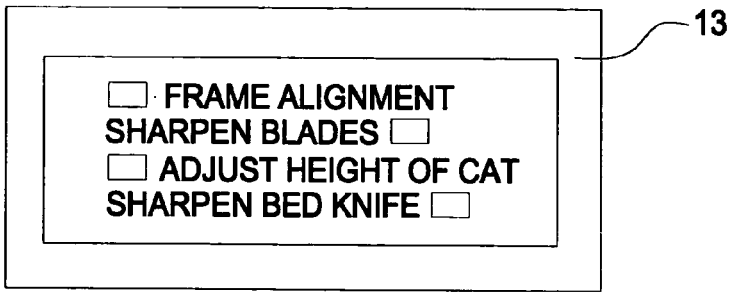
FIGS. 14, 15A, 15B, 15C are front plan views of the control panel screen sequence calibrating the type of cutting unit to be conditioned.

Referring next to FIG. 14 the touch screen 13 is displaying the choose function screen with the primary function options displayed.

Figure 15A:
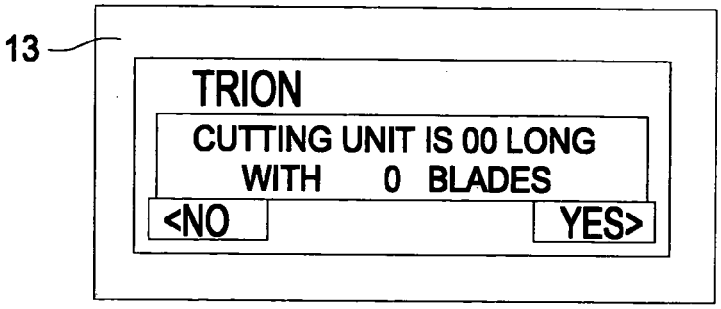
Figure 15B:
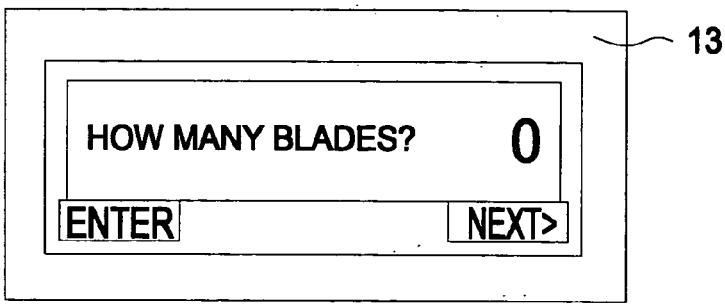
Figure 15C:
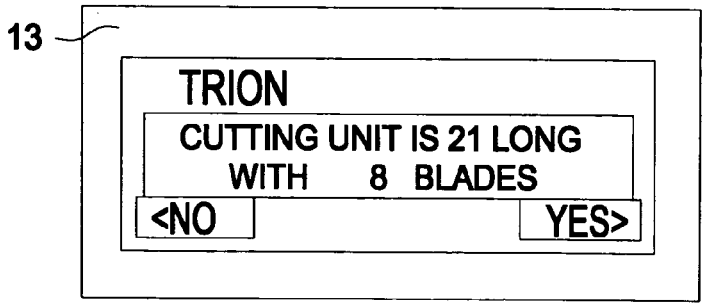

Referring next to FIGS. 15A, 15B, 15C the touch screen 13 shows the sequence the machinist uses to instruct the computer that the cutting unit has eight blades and is 21 inches long. The machinist touched NO in FIG. 15A, NEXT in FIG. 15B until 8 was displayed, and entered 21 in the same manner (not shown) as FIG. 15B, which resulted in a ready screen, FIG. 15C.

Figure 17:
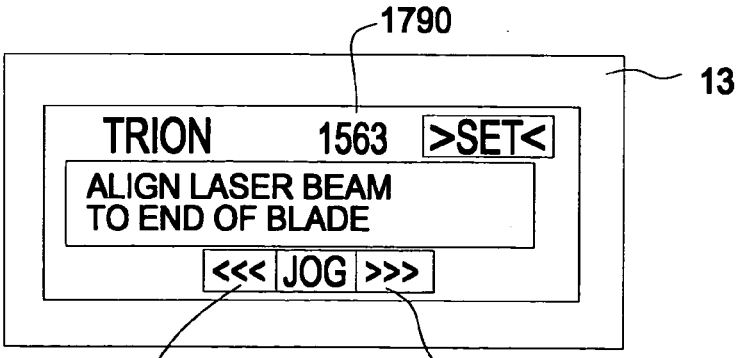
FIG. 17 is a front plan view of the control panel screen as it relates to the laser scanner position shown in FIG. 16.
Figure 16:
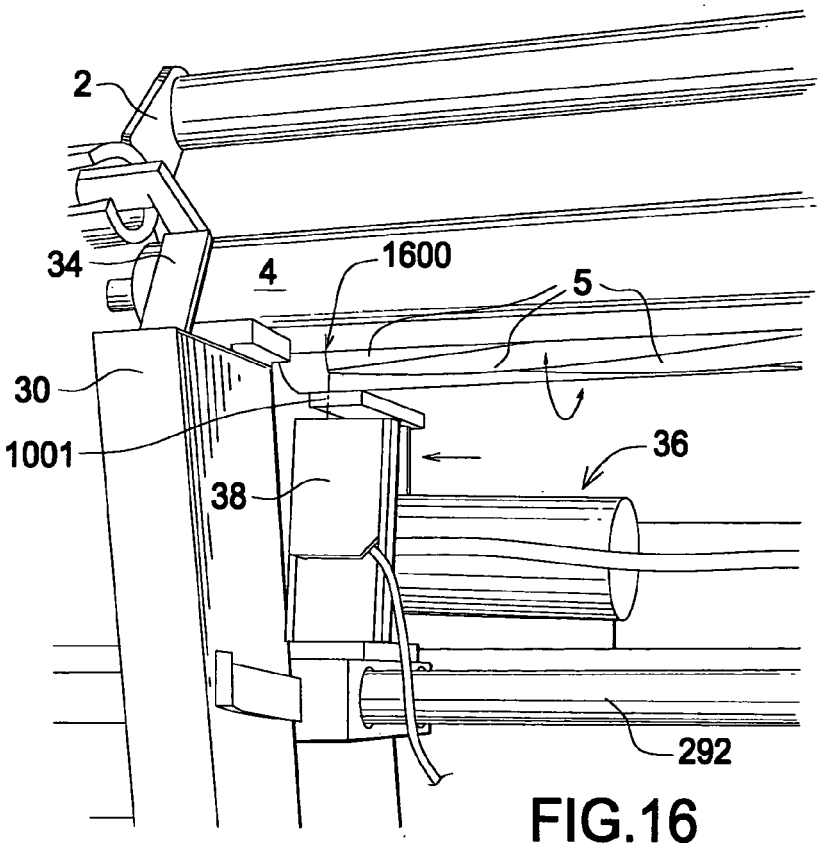
FIG. 16 is a rear perspective view of the laser scanner determining an end point of the cutting blade.

In FIG. 16 the machining head assembly 36 has been moved left, L, until the laser beam 1001 is located at the left end 1600 of the reel blade 5. In FIG. 17 the touch screen 13 shows the H.O.C. as 1563 field 1790 when the laser beam is at the left end 1600 of the reel blade 5. If the machinist moved the laser beam more left by touching field 1791, then the laser beam would reflect off a much higher surface and show a much bigger H.O.C.

The machinist moves the laser beam 1001 to the right by touching field 1792.

Figure 18:
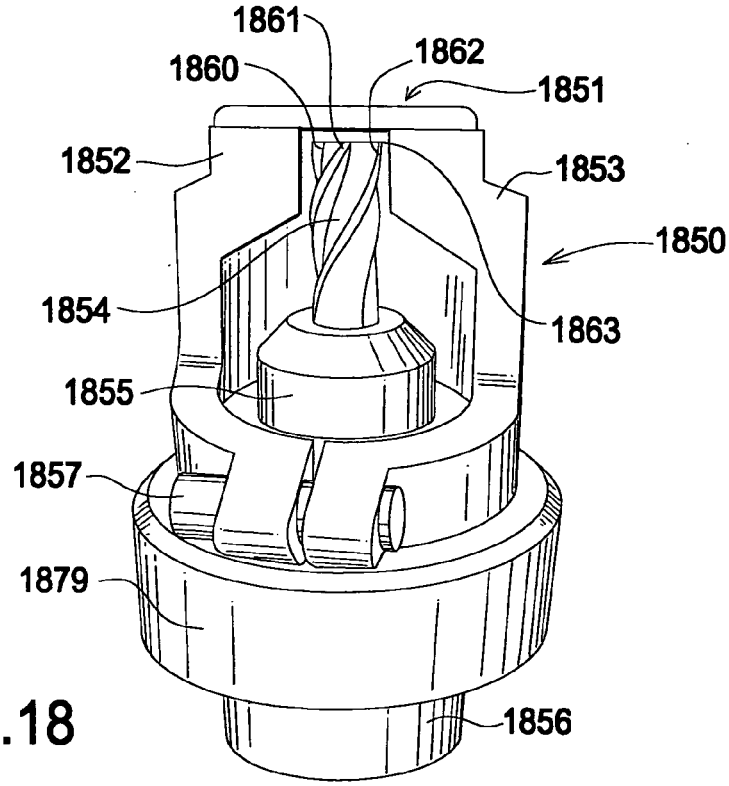
FIG. 18 is a close up front plan view of an alternate embodiment blade cutter head.

Referring next to FIG. 18 the cutting assembly 1850 is a unique invention. A base 1856 is mounted to the cutting head assembly 36, FIG. 2. A blade guide 1851 has a left half 1852 and right half 1853 which push against the blade 5. A bolt 1857 locks the halves 1852,1853 to the base 1856.

The end cutter 1854 rotates so that cutter tips 1860,1861, 1862 machine the edge of the blade 5 sharp. The blade guide 1851 keeps the edge of blade 5 right over the point of metal removal 1863 of the end cutter 1854.

Figure 19:
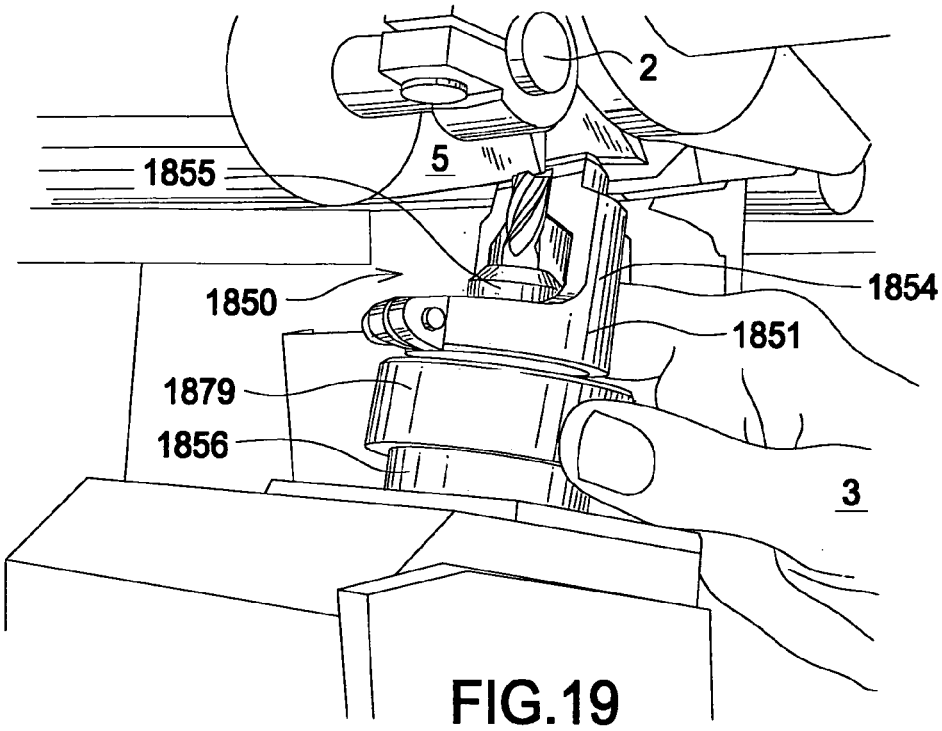
FIG. 19 is a right side perspective view of the blade cutter being adjusted to the blade.

In FIG. 19 the machinist adjusts the cutting assembly 1850 against the blade 5 at the start of the cutting process with the adjusting knob 1879, and raising/lowering the spindle 1855, alternatively he uses hand wheel 16 shown in FIG. 1.

Figure 20:
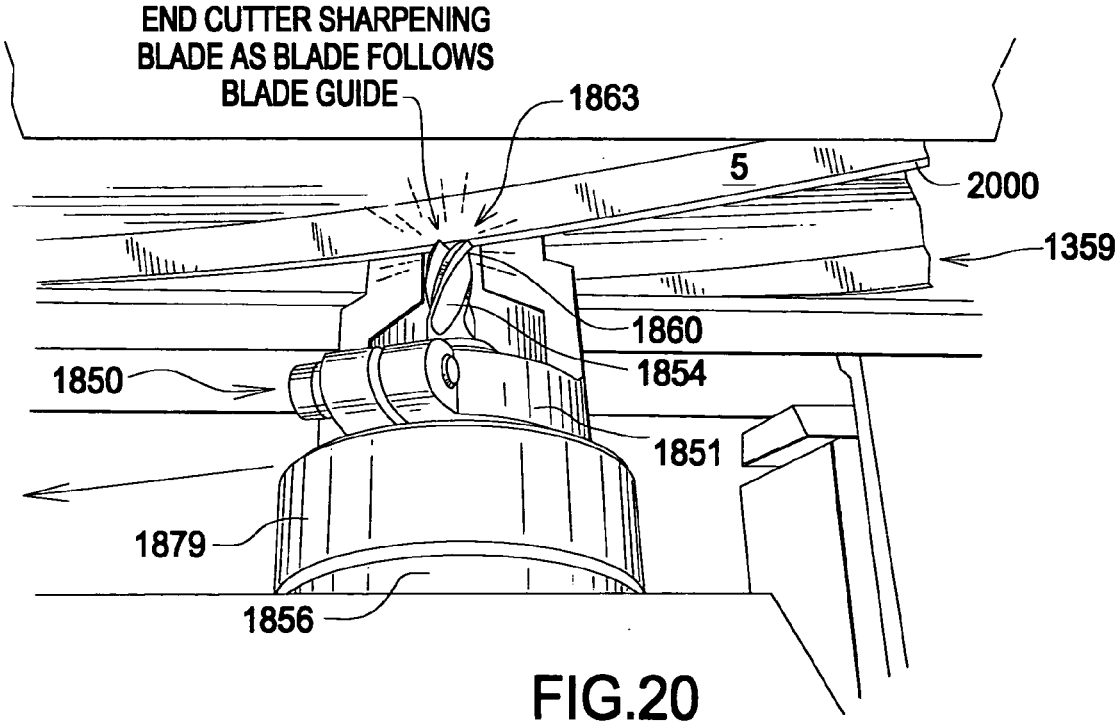
FIG. 20 is a front perspective view of the blade end cutter sharpening an edge of the blade.

In FIG. 20 the edge 2000 of the blade 5 is being held exactly over the point of metal removal 1863 by tip 1860 of the end cutter 1854 by the blade guide 1851. The end cutter 1854 could have from 2 or more blade tips. A portion 2293 (FIG. 23) of the top of the blade guide 1851 acts as a stop for blade 5 as the cutting assembly 1850 moves left, L, and the reel cylinder 1359 is rotated by the reel drive system with slip clutch 28.

Figure 21:
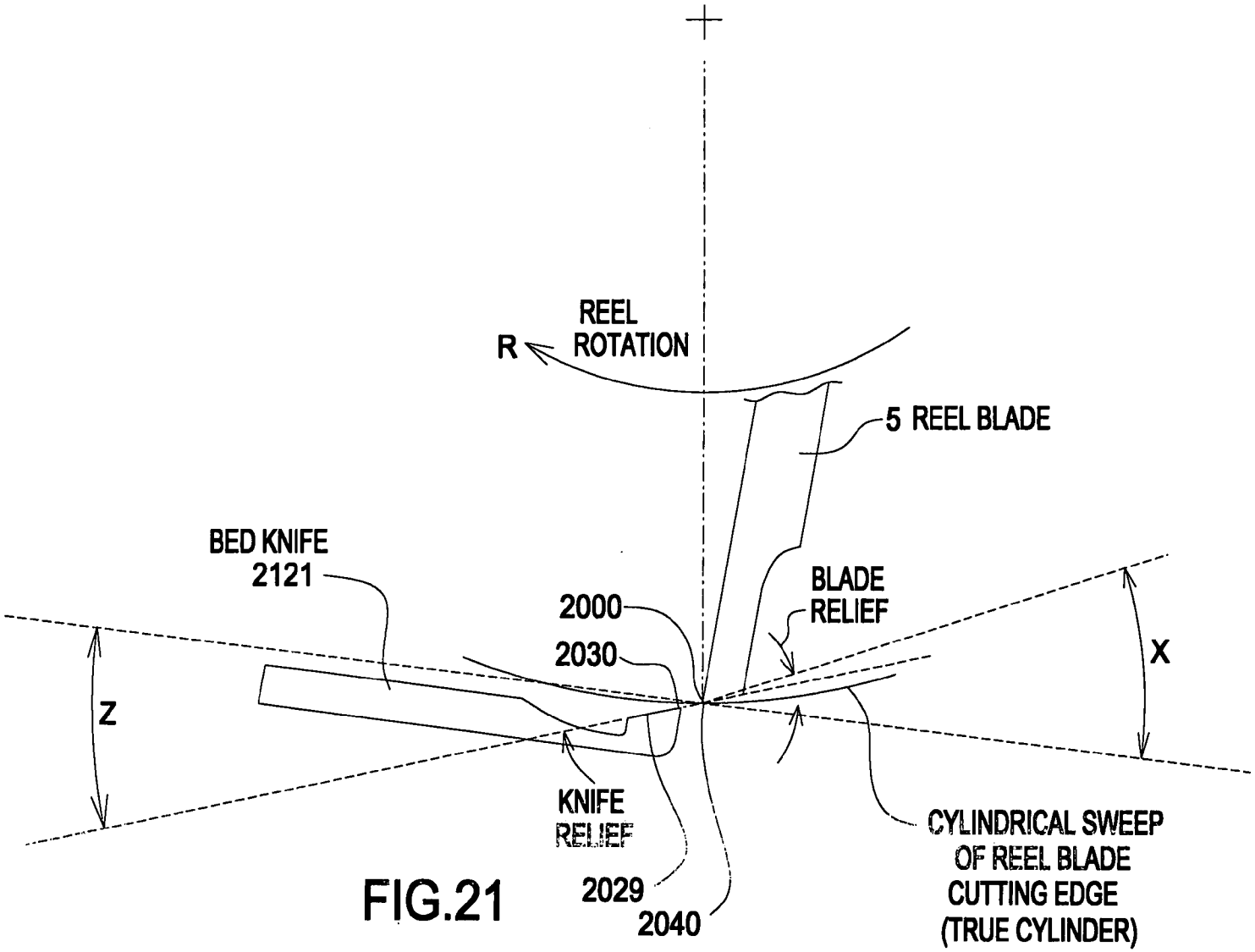
FIG. 21 is a schematic view of the bed knife and reel blade cutting geometry.

Referring next to FIG. 21 the reel rotation direction R forces the blade 5 edge 2000 to sweep past the bed knife 2121 at its tip 2029. The cutting action takes place at the confluence of the leading edges of the bed knife and the reel blade, 2030 and 2040 respectively. The bed knife relief angle Z may be different than the reel blade relief angle X.

Figure 22:
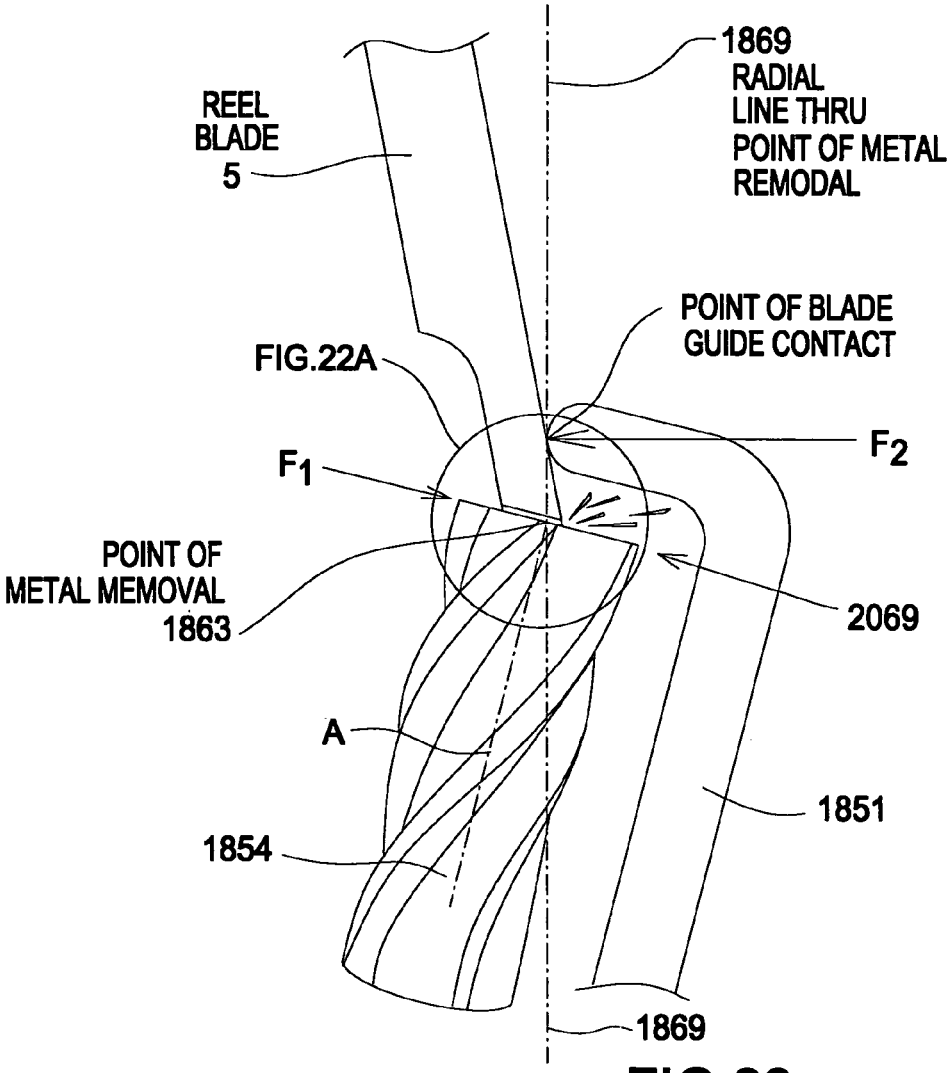
FIG. 22 is a schematic of the end cutter and reel blade guide sharpening the reel blade.
Figure 24:
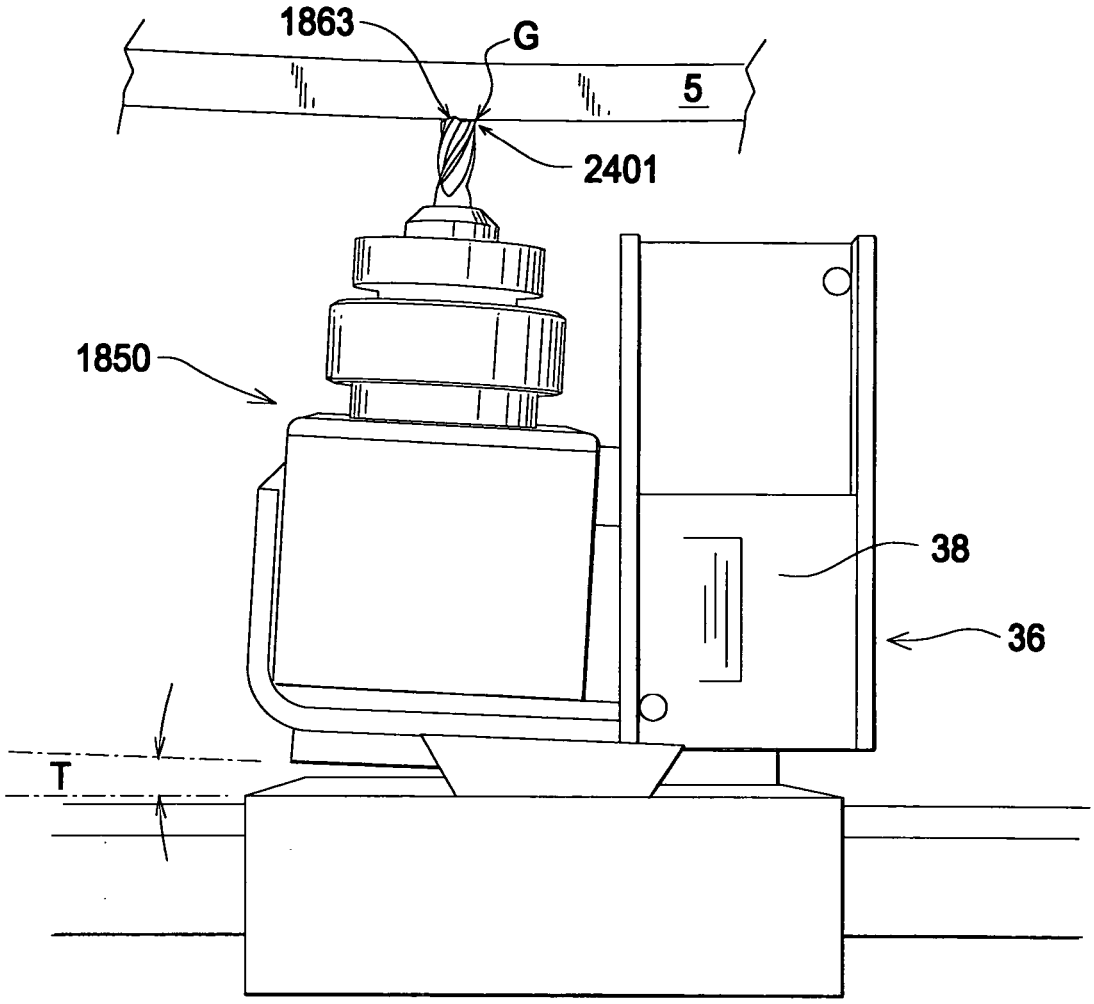
FIG. 24 is a side plan view of the cutter angle required for the end cutter leading edge to do cutting.

Referring next to FIG. 22 the end cutter 1854 has end points 1860, 1861, 1862 as shown in FIG. 18. Point 1863 is the point of metal removal because the end cutter 1854 is slightly tilted relative to the arc of the blade 5 as best shown in FIG. 24. The cutting force F, against the blade 5 is resisted by the blade guide force F2, and ideally the point of balance between forces F1, F2 occurs along axis 1869, which passes though the longitudinal axis A of the end cutter 1854 at its tip 2069.

Figure 23:
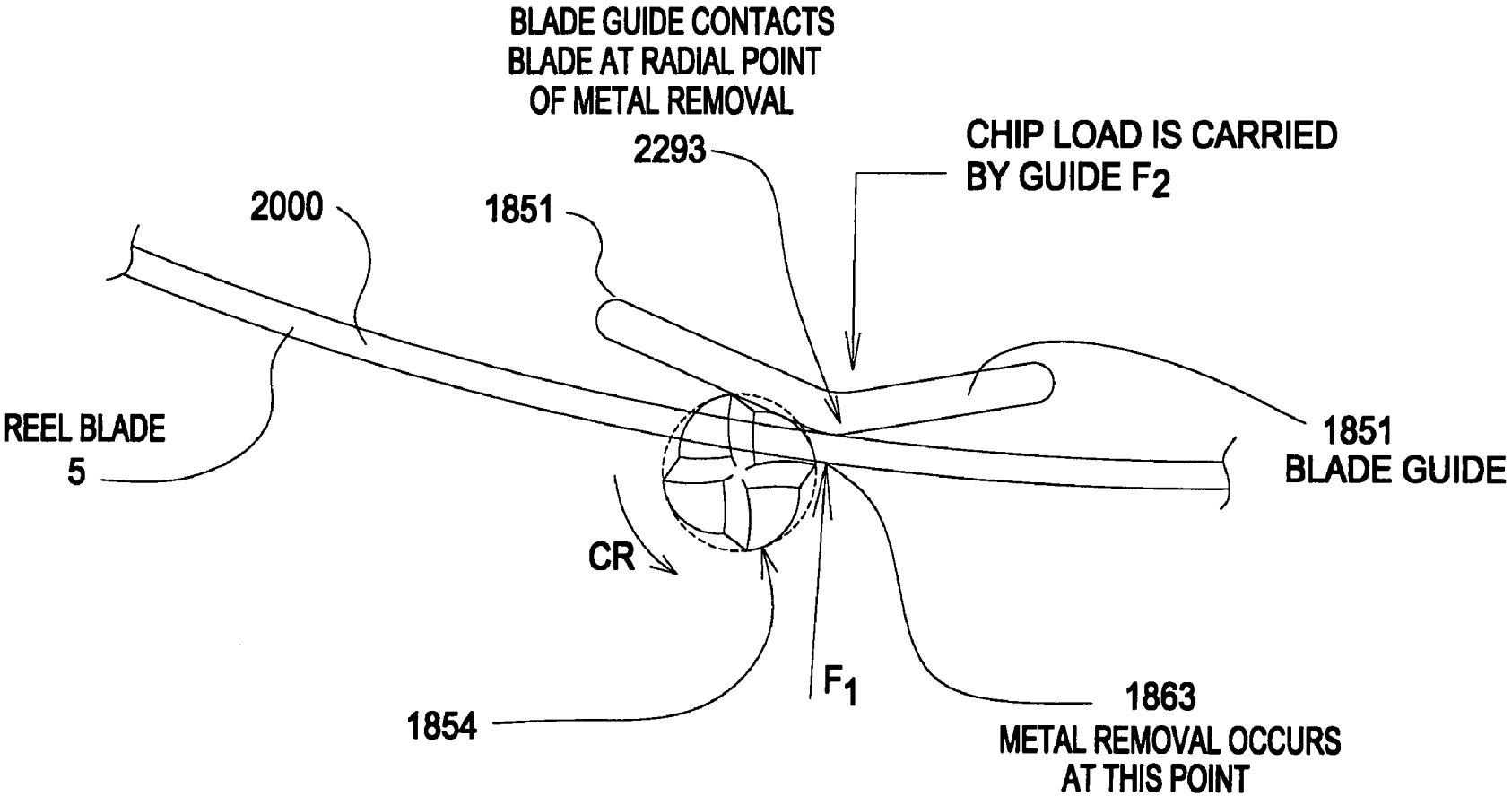
FIG. 23 is a top plan view of the end cutter in action.

Referring next to FIG. 23 this top plan view describes the forces shown in FIG. 22. The end cutter 1854 rotates in direction CR. The forces F1, F2 are equalized at the point of metal removal 1863.

Referring next to FIG. 24 the cutting assembly 1850 is slightly tilted at angle T (range from about 3 to about 20 degrees) so as to have the cutting tips 1860, 1861, 1862 contact the blade edge 2000 at point 1863. There exists a gap G at point 2401 between the end cutter 1854 and the blade 5.

Figure 22A:
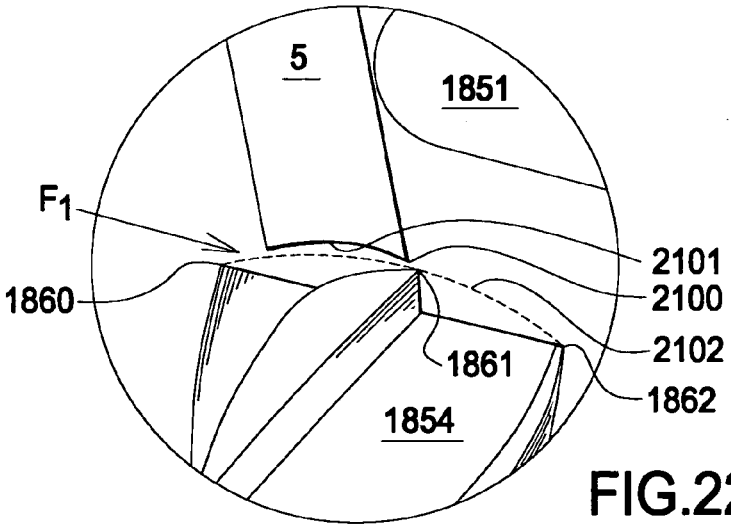
FIG. 22A is a close up of the blade of FIG. 22.

This angle T tilts the cutting head of the tool 1854, thereby forming a concave relief (FIG. 22A, 2101); additionally the leading cutting edge 2100 appears to stay sharper longer with this concave relief. The cutting assembly 1850 may be a high speed (circa 20,000 rpm) machining head having a carbide cutting tool.

Figure 25:
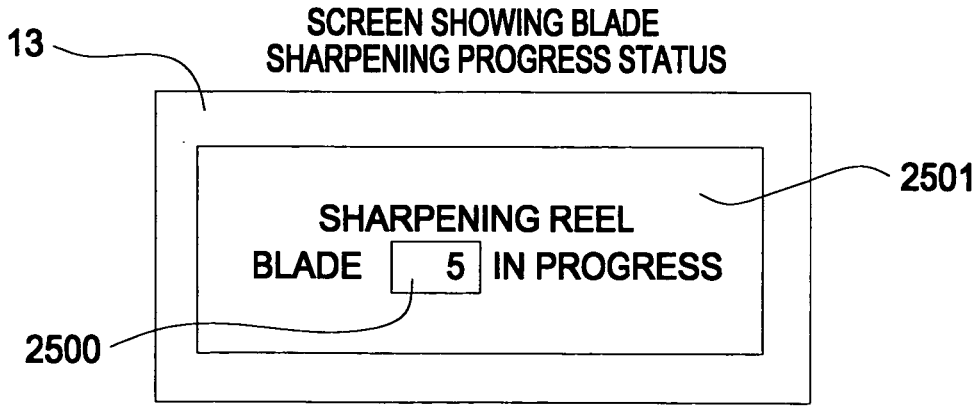
FIG. 25 is a front plan view of the control panel screen during a sharpening process.

Referring next to FIG. 25 the touch screen 13 field 2501 displays the status that a sharpening process is proceeding. Field 2500 has automatically advanced from blade 1 to blade 5 via computer control.

Figure 26:
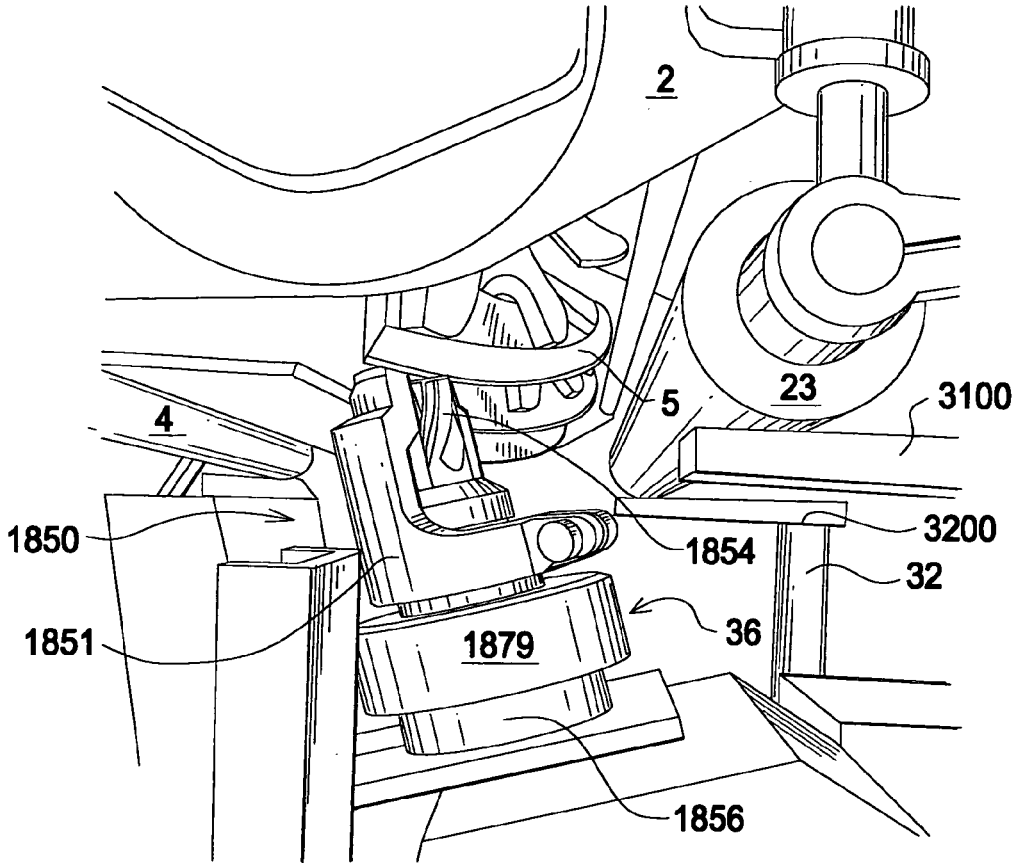
FIG. 26 is a right side plan view of the blade in contact with the cutter and the blade guide and performing the one pass sharpening operation.

Referring next to FIG. 26 this end perspective view shows the blade 5 pushed against the blade guide 1851 by the rotational force of the reel drive system with slip clutch 28. The machining head assembly 36 could be moving away from the viewer into the page or vice versa for a sharpening process.

Figure 27:
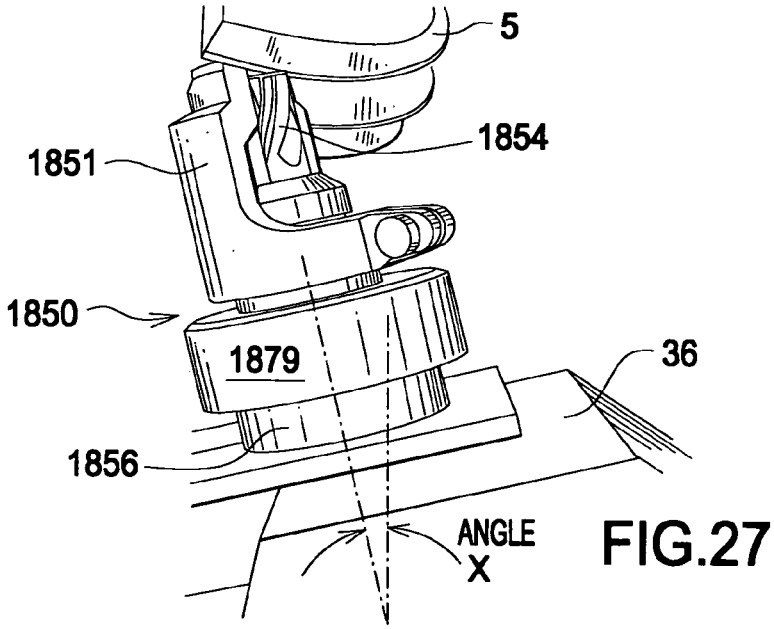
FIG. 27 is a side plan view of the blade machining assembly showing angle of cutter to blade to provide relief.
Figure 33A:
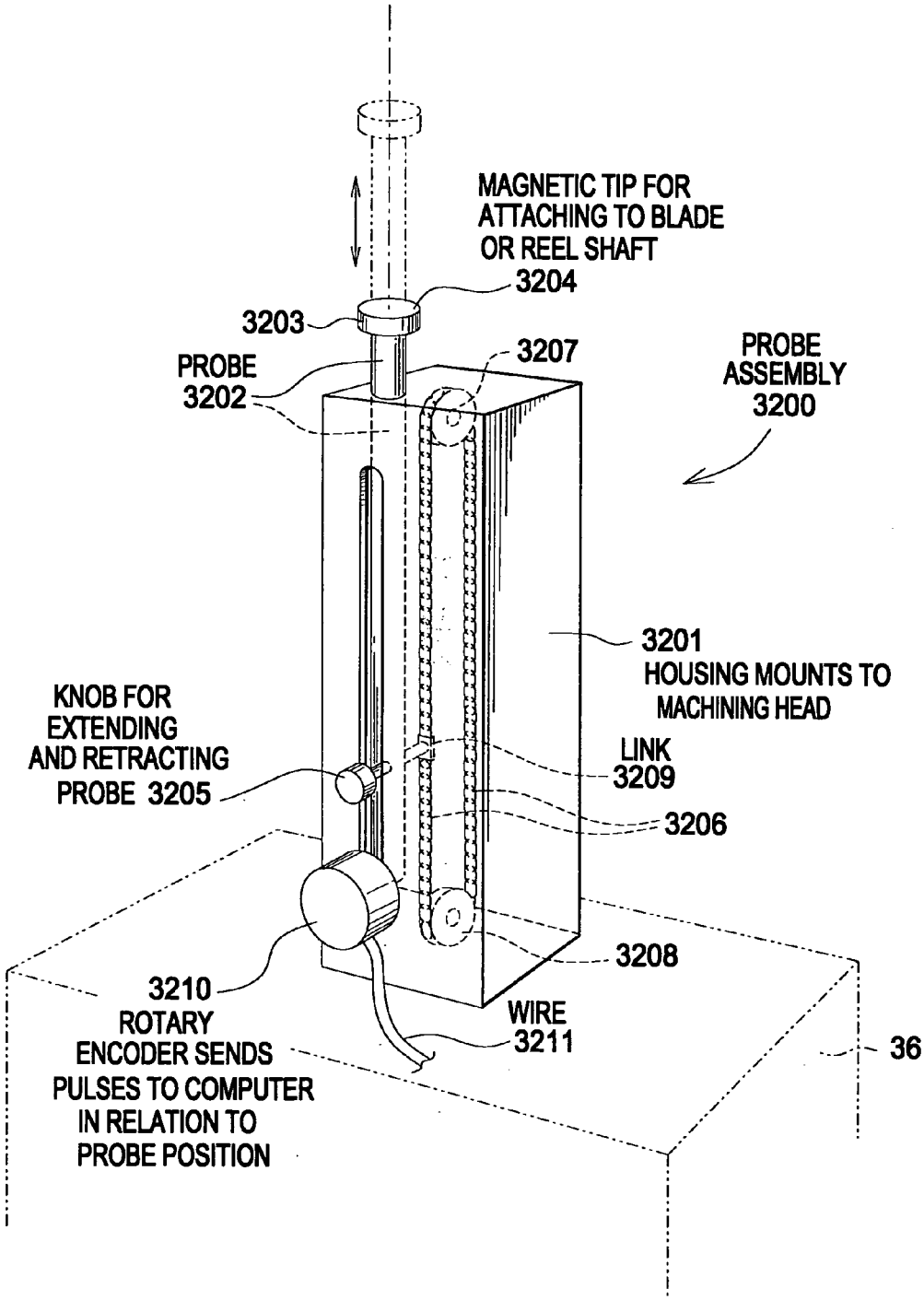
FIG. 33A is a perspective view of a mechanical probe used in place of the laser to determine the cutting height.
Figure 33B:
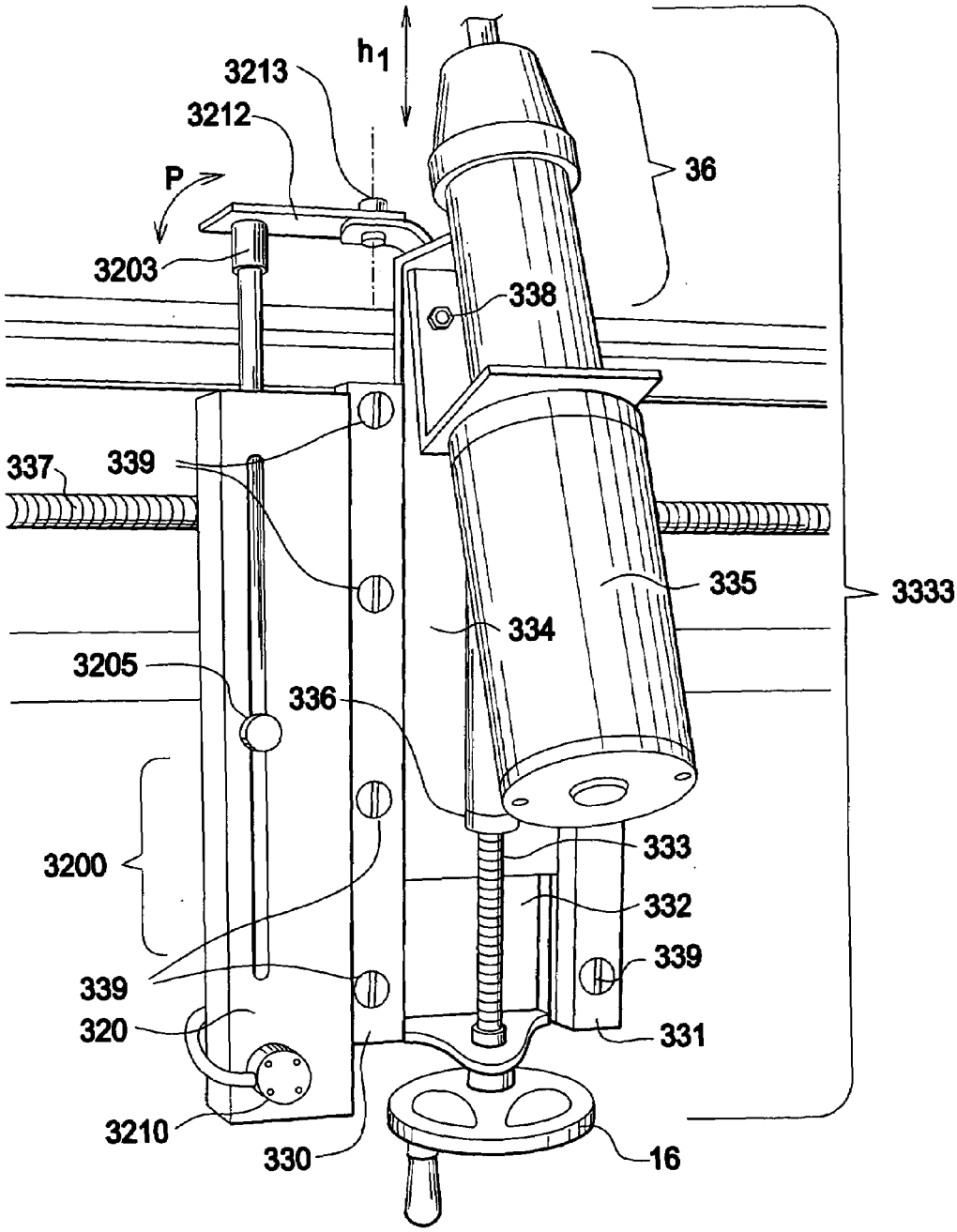
FIG. 33B is a front perspective view of the machining head/probe assembly, the preferred embodiment.

Referring next to FIG. 27 the cutting assembly 1850 is mounted to the machining head assembly 19 as shown in FIGS. 1, 33B at a fixed angle (ranging from about 1 to 15 degrees) sufficient to put a relief cut in the blade edge, see number X, FIG. 21.

Figure 28:
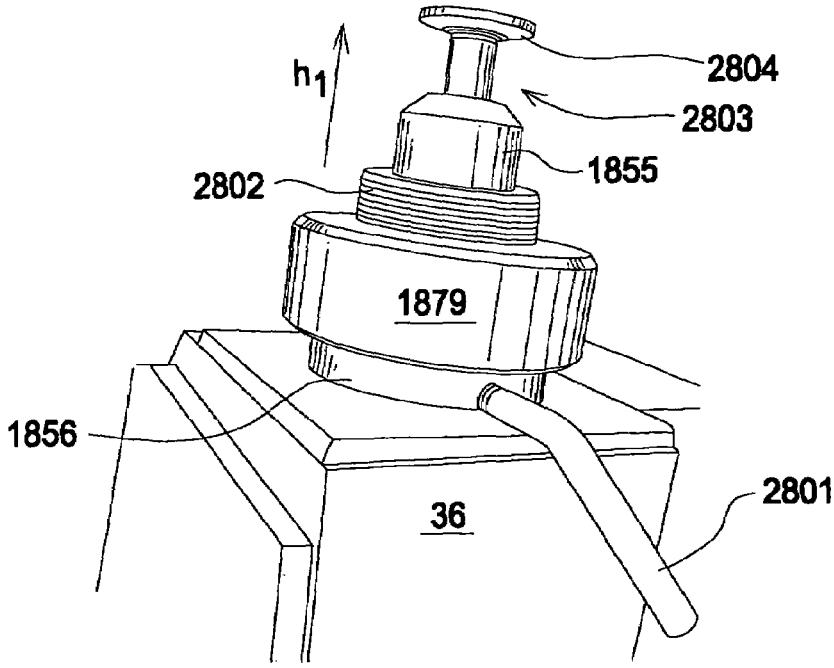
FIG. 28 is a perspective view of the bed knife cutting tool.

Referring next to FIG. 28 the setup for the bed knife sharpening process has been done. The bed knife cutting tool 2803 has been fastened into the spindle assembly 1855 in place of the end cutter 1854. The cutting edge 2804 is located on the bottom face of the bed knife cutting tool 2803. The threads 2802 of the spindle assembly 1855 can be seen which enable the height $h_1$ of the spindle 1855 to be adjusted by knob 1879. The locking lever 2801 tightens the base 1856 to the outside of the spindle assembly 1855.

Figure 29:
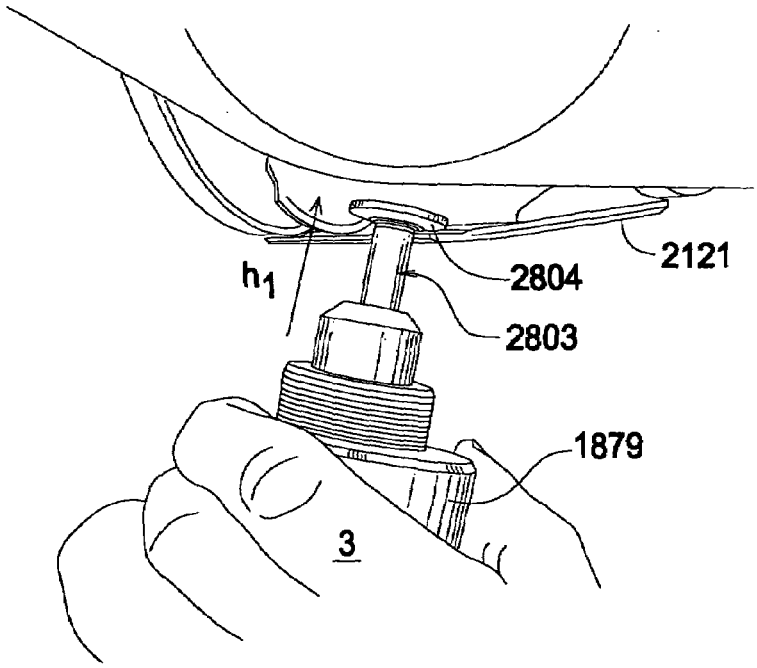
FIG. 29 is a perspective view of a manual adjustment of the bed knife cutting tool against the bed knife cutting edge.

Referring next to FIG. 29 the machinist 3 is adjusting the height $h_1$ of the bed knife cutting tool 2803 using adjusting knob 1879 or alternatively using hand wheel 16 shown in FIG. 1 so as to make the cutting edge 2804 touch the bed knife 2121 at its tip 2029 as seen in FIG. 21. This adjustment and the angle X seen in FIG. 27 machines an angle Z of FIG. 21.

Figure 30:
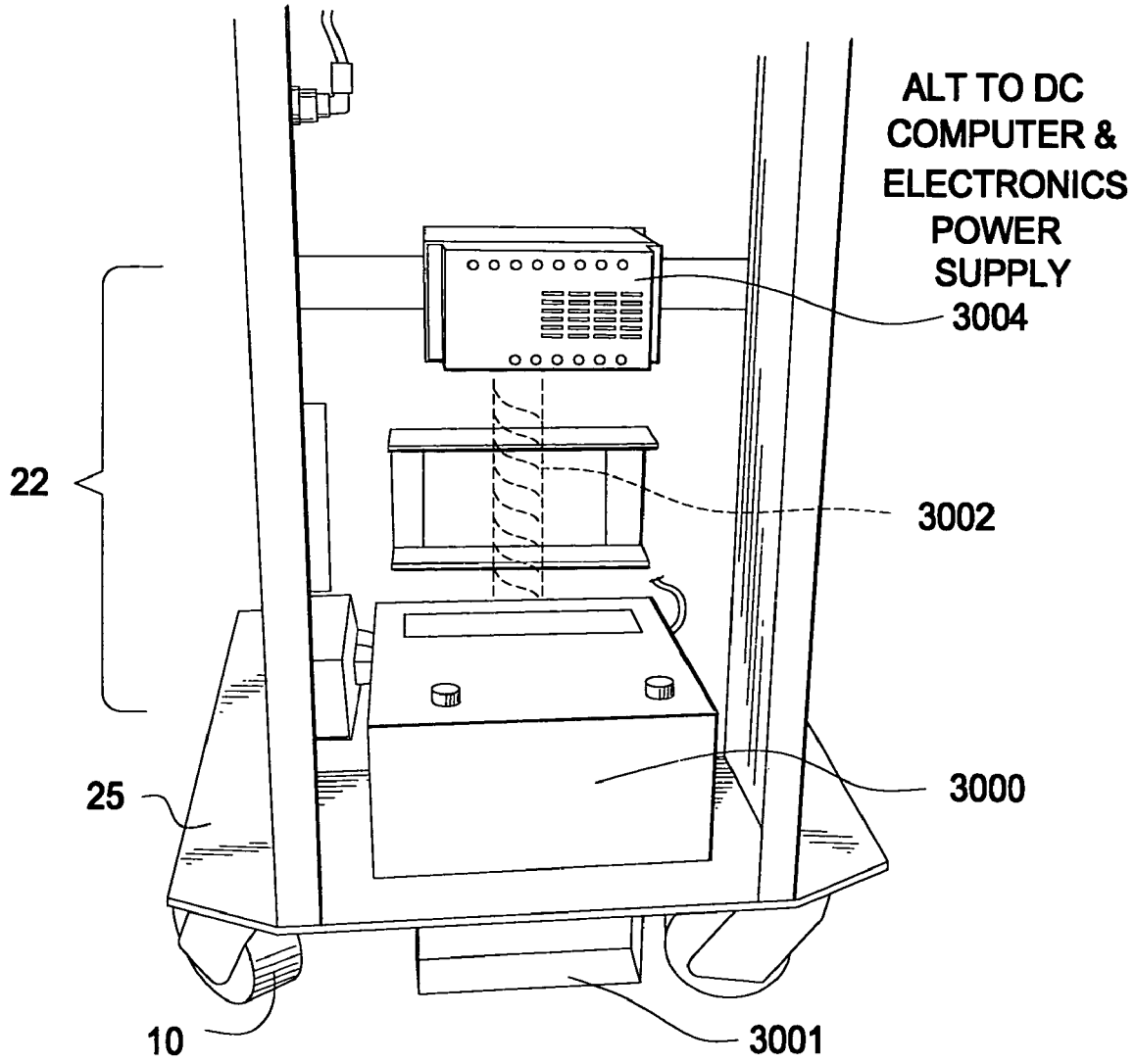
FIG. 30 is a rear plan view of the electronic control subassembly.

Referring next to FIG. 30, the base 22 has a car battery 3000 to run the electronics, other than the computer. A solid state power supply could be used. A motor 3001 powers a screw shaft 3002 to provide the raise/lower action for the machining sub-assembly 51 of FIG. 2. The AC/DC power supply 3004 runs the computer, (preferably a PC based imbedded computer, however a PLC can be used) 34.

Figure 32:
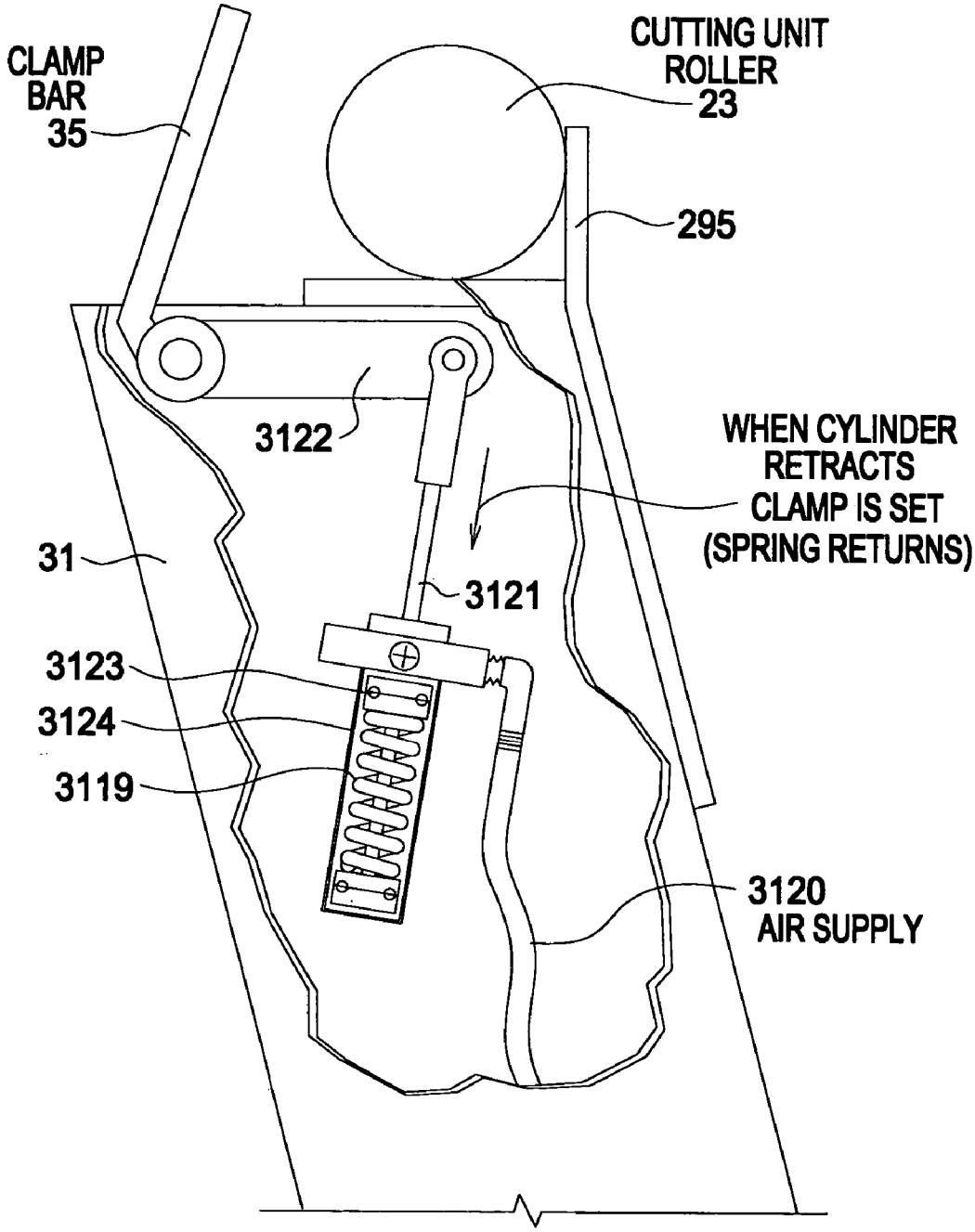
FIG. 32 is a side partial cutaway view of the clamp bar assembly.

Referring next to FIG. 32 the roller clamp 35 is closed by pressurizing an air cylinder 3119 via air supply 3120. The piston 3123 is returned to the up position as shown by spring 3124. The piston 3123 is attached to the rod 3121 which in turn is attached to the linkage 3122 which in turn is attached to the roller clamp 35.

Referring next to FIGS. 33A, 33B a probe assembly 3200 can be substituted for the laser assembly 38. A housing 3201 is mounted to the machining head assembly 36, forming machining head/probe assembly 3333. Arm 3212 as shown is pivoted to allow the magnet 3203 to attach to the arm 3212. In this position the operator can finely adjust the probe 3202 with the manual machining head adjustment 16. The operator can measure the cutter position $h_1$ as shown in FIG. 33B. When the arm 3212 is pivoted away as shown by arrow P, the probe 3202 can be operated independently as described below. The probe 3202 is slidably mounted inside the housing 3201. The tip 3203 of the probe 3202 comprises a magnet having a flat top surface 3204 to engage a blade edge 2000 or the core of the reel cylinder 1359, the core usually consists of a shaft on which the blades 5 are mounted. The handle 3205 is attached to the probe 3202 and is manually lifted by the machinist for the measuring operations. The purpose of the magnet in the tip 3203 is to enable the probe 3202 to stick to the measured surface, thereby allowing the machinist to free up both hands.

Referring to FIG. 33B the preferred embodiment of the machining head/probe assembly 3333 is shown. Base 332 contains a stationary nut that moves the base 332 as screw 337 is powered by 1616 best shown on FIG. 1. The machining head 19 is powered by motor 335. The machining head 19 is attached to slide 334 by bolts 338. The slide engages left guide 330 and right guide 331 that are bolted to the base 332 by bolts 339. The slide 334 contains a stationary nut 336 which engages screw 333 which is turned by means of hand wheel 16. The position of the machining head 19 can be finely positioned shown by arrow h1 using the hand wheel 16. Also attached to the base 332 is a manually movable arm 3212 which pivots as shown by arrow p by means of pivot 3213. Additionally the probe assembly 3200 is bolted to base 332 by bolts not shown. With the arm 3212 in position over the magnet 3203 of the probe assembly 3200, the position h1 of the machining head 19 can be determined by the probe assembly 3200 and displayed to touch screen 13 best shown on FIG. 1. With movable arm 3212 not positioned over magnet 3203 the probe can be manually operated by means of handle 3205 as described in discussion of FIG. 33A.

The chain 3206 is continuous and is wound around the upper sprocket 3207 and the encoder sprocket 3208. The probe 3202 is attached to the chain 3206 by a link 3209. In operation the probe 3202 is lifted to the blade edge 2000, thereby turning the encoder sprocket 3208 which in turn generates an electric signal from the encoder 3210 which signal is transmitted via wire 3211 to the computer (preferably a PC based imbedded computer, however a PLC can be used) 34. Equivalent probe assemblies could use automatically extending probes.

Figure 34:
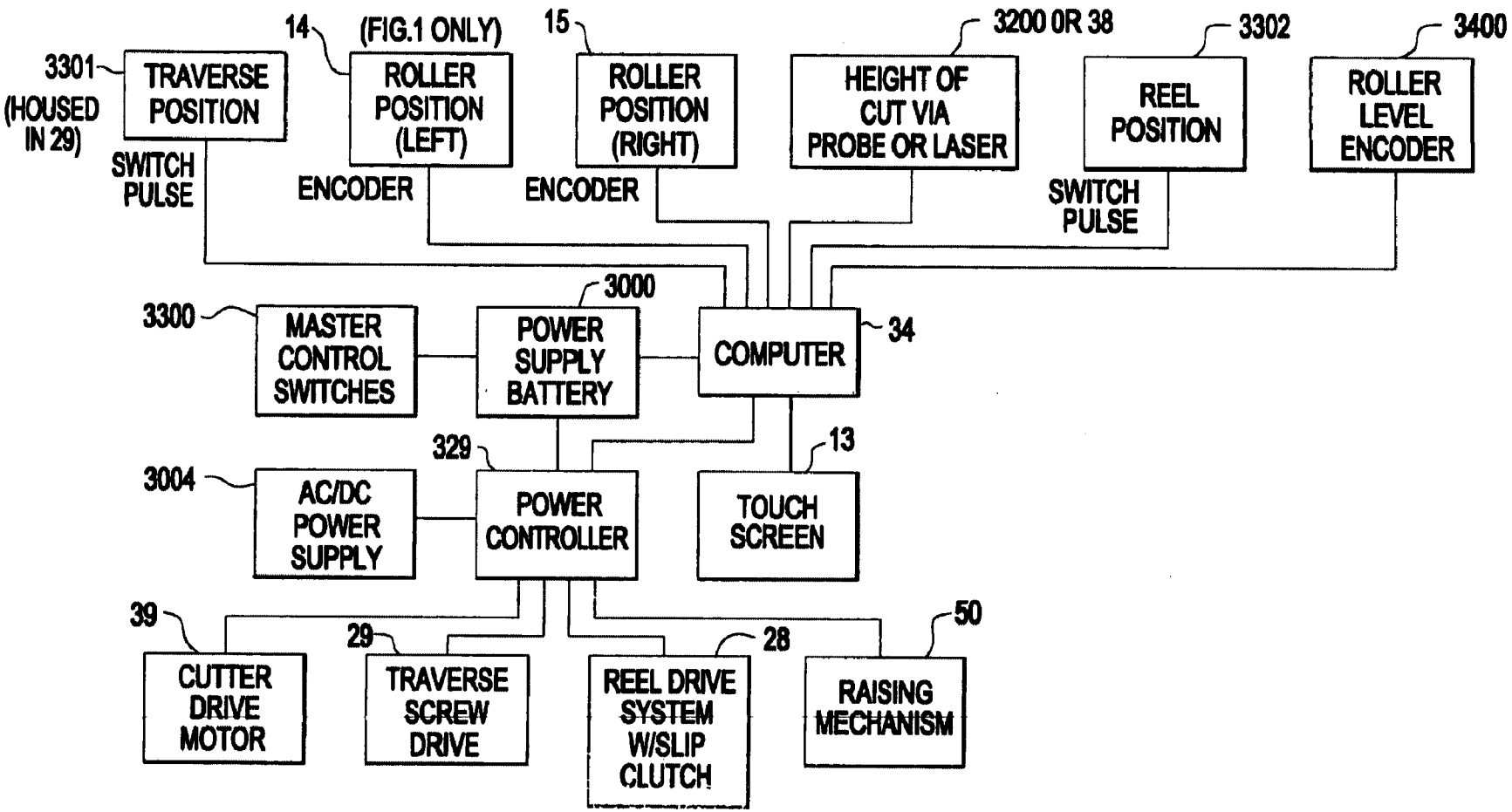
FIG. 34 is a schematic of the functioning of the various components of the system.

Referring next to FIG. 34 a schematic of the input, output and control functions is shown in a modular layout.

Figure 35A:
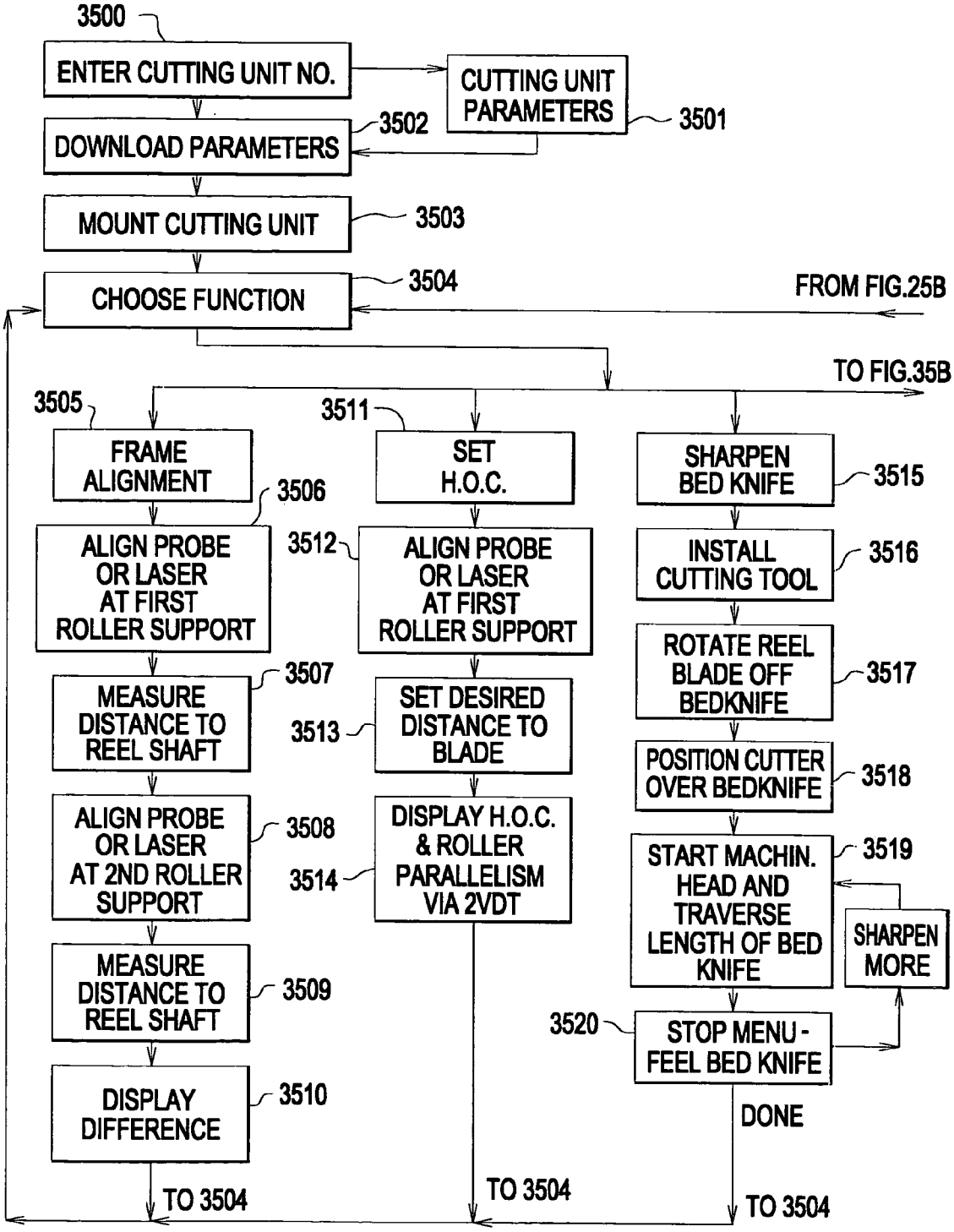
FIGS. 35A, 35B are a flow chart of system logic.
Figures 35B, 35C:
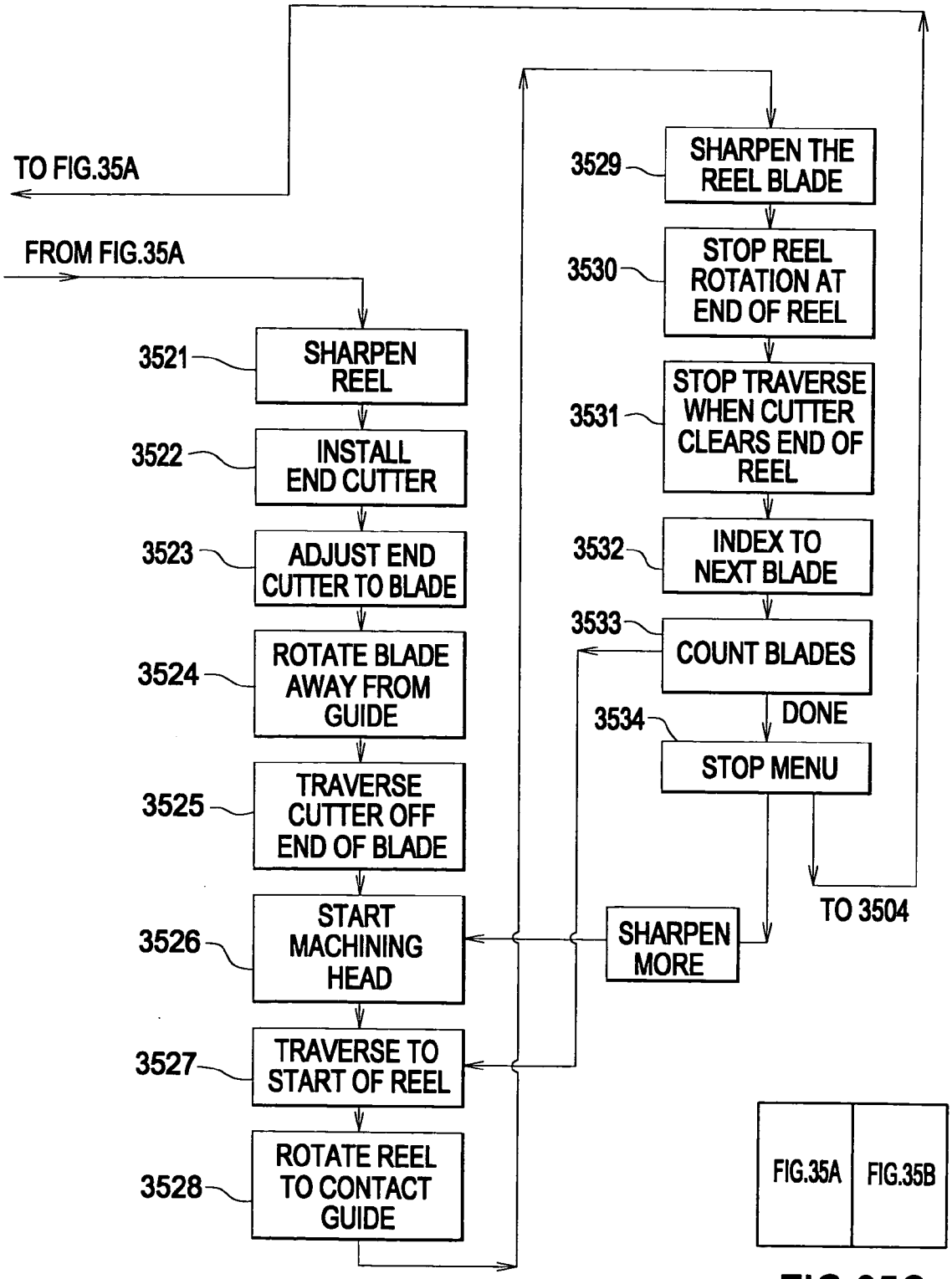

Referring next to FIGS. 35A, 35B a control logic schematic of the mower conditioner 20 is shown. Block 3500 requires entry of an identification number for a particular cutting unit. Block 3501 requires entry of the cutting unit parameters including blade count. Block 3502 designates the start of the conditioning of a chosen cutting unit. Block 3503 mounts the cutting unit onto the conditioner. Block 3504 provides the machinist with the choose function screen.

Block 3505 represents starting the frame alignment process (see FIG. 14). Block 3506 represents positioning the probe or laser at the first (left) roller support. Block 3507 represents measuring the distance to the reel cylinder core. Blocks 3508, 3509 represent positioning and measuring the distance to the reel cylinder core at the second (right) roller support. Block 3510 displays any difference in distances from the left to the right ends of the reel cylinder to allow the machinist to adjust the roller to eliminate any difference.

Block 3511 starts the height of cut (H.O.C.) process by adjusting the height of the opposite roller that is set in the frame alignment process (see FIG.12). Block 3512 indicates positioning the probe or laser at one end of a cutting unit. Block 3513 indicates the machinist setting his desired H.O.C. Block 3514 shows the FIG. 11 touch screen wherein the machinist has leveled the opposite end of the roller which has been set at the desired H.O.C.

Block 3515 starts the bed knife sharpening process. Block 3516 instructs the machinist to install the bed knife cutting tool (see FIG. 28). Block 3517 instructs the machinist to rotate the reel blade 5 out of the way. Block 3518 instructs the operator to position the bed knife cutter to the bed knife (see FIG. 29). Block 3519 sharpens the bed knife. Block 3520 indicates the first sharpening pass is done, and the machinist can feel the bed knife and decide whether to repeat the process.

Block 3521 starts the reel blade sharpening process. Block 3522 instructs the machinist to mount the end cutter 1854 (see FIG. 18). Block 3523 instructs the machinist to adjust the height of the end cutter (see FIG. 19). Optional block 3524 automatically rotates the blade 5 away from the end cutter, then Block 3525 automatically moves the end cutter outbound from the end of the blade 5, then Block 3526 automatically powers up the end cutter to rotate, then Blocks 3527, 3528 move the end cutter toward the blade slowly, then senses the powered rotation of the reel cylinder 1359 stopped by the blade guide 1851, leaving the end cutter outbound from the blade 5. Now Block 3529 automatically traverses the end cutter across the length of the reel blade.

Block 3530 automatically measures the traverse of the end cutter and compares the traverse to the known length of the reel blade. When the end cutter reaches the end of the reel blade, then the reel cylinder rotation is stopped, thereby leaving the reel blade at a known rotational position. The end cutter continues to traverse. Block 3531 automatically stops the traverse when the blade guide clears the end of the reel blade, thereby enabling a rotation of the reel cylinder to index to the next blade position as indicated by Block 3532. Block 3533 indicates the counting of the blades to automatically repeat the sharpen blade process until all blades are sharpened. Block 3534 allows the machinist to feel the blades and decide if another sharpening cycle should be done.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A reel type lawnmower conditioner comprising:

a base supporting a frame;

said frame having a computer entry/display device;

a reel blade assembly blade guide;

a blade sensing means functioning to measure a variable distance of at least two points along a blade edge of a reel blade assembly to a reference point on the frame;

said reel blade assembly having a plurality of helical blades;

a reel blade assembly rotational drive controlled by a computer;

a machining head mounted on a transverse drive assembly;

said machining head having a cutting tool;

wherein the computer stores the measured variable distances and then operates the machining head on the transverse drive to machine the blade edge to a new distance from the reference point; and wherein the blade sensing means functioning to measure a variable distance further comprises a transverse drive assembly carrying a transversely movable mechanical assembly having a vertically oriented probe; said probe having a manual adjustment mechanism to extend a probe tip upward to touch a blade edge of a blade of the reel blade assembly, and having an electronic encoder to transmit the measured variable distance to the computer.

2. The conditioner of claim 1, wherein the probe tip and the machining head are connected together on the transverse drive assembly for the machining head.

3. The conditioner of claim 1, wherein the probe tip has a magnet to magnetically connect to the blade edge of a blade of the reel blade assembly.

4. A reel type lawnmower conditioner comprising:

a base supporting a frame;

said frame having a computer entry/display device;

a reel blade assembly blade guide;

a blade sensing means functioning to measure a variable distance of at least two points along a blade edge of a reel blade assembly to a reference point on the frame;

said reel blade assembly having a plurality of helical blades;

a reel blade assembly rotational drive controlled by a computer;

a machining head mounted on a transverse drive assembly;

said machining head having a cutting tool;

wherein the computer, stores the measured variable distances and then operates the machining head on the transverse drive to machine the blade edge to a new distance from the reference point; and a roller alignment assembly having a lock for a first roller of the reel blade assembly and a parallelism sensor to detect an out of parallel position between the first roller and a second roller of the reel blade assembly.

5. The conditioner of claim 1, wherein the base is movable so as to be moved under a reel type lawnmower on a lift.

6. The conditioner of claim 5, wherein the base further comprises a lift assembly means functioning to raise the machining head to contact the blade of the reel blade assembly.

7. The conditioner of claim 6, wherein the blade sensing means comprises a mechanical probe sensor connected to the computer.

8. The conditioner of claim 1, wherein the computer controls the reel blade assembly rotational drive to slowly rotate the reel blade assembly while maintaining the blade sensing means in contact with the blade edge of the reel blade assembly of the reel blade assembly.

9. The conditioner of claim 8, wherein the computer, during a machining operation, controls a transverse movement of the machining head having a cutting tool, while slowly rotating the reel blade assembly to perform a machining action along an entire length of each blade edge of the reel blade assembly at the new distance from the reference point.

10. The conditioner of claim 9, wherein the machining head further comprises a fine adjustment mechanism to place the cutting tool at a precise cutting distance relative to the blade of the reel blade assembly.

11. The conditioner of claim 1, wherein the parallelism sensor further comprises a rocker arm assembly having a sensor to calibrate a tilt of the rocker arm which indicates an out of parallel alignment between the first and the second rollers of the reel blade assembly.

12. The conditioner of claim 11, wherein the machining head further comprises a distance probe to indicate an out of parallel condition between a roller shaft of the reel blade assembly and the first roller of the reel blade assembly.

13. The conditioner of claim 12 further comprising a height of cut (H.O.C.) assembly having a movable roller that is manually adjustable to a desired H.O.C. using the distance probe, and wherein the rocker arm assembly is used to ensure a parallel condition between the first and the second rollers of the reel blade assembly.

14. The conditioner of claim 1, wherein the machining head further comprises a distance probe to determine a variation between a reference plane and an edge of a bed knife of the reel blade assembly.

15. The conditioner of claim 14, wherein the machining head further comprises a removable cutting tool to sharpen the bed knife of the reel blade assembly.

* * * * *